US011735020B2

(12) United States Patent
Drummond

(10) Patent No.: US 11,735,020 B2
(45) Date of Patent: Aug. 22, 2023

(54) COMBINED HEAT-SMOKE DETECTOR WITH A SHIELDING CONTROLLED BY A THERMAL BOLT CONTAINING A THERMAL ELEMENT CHANGING ITS STATE AT A THRESHOLD TEMPERATURE

(71) Applicant: Mara Christine Drummond, Catonsville, MD (US)

(72) Inventor: Mara Christine Drummond, Catonsville, MD (US)

( * ) Notice: Subject to any disclaimer, the term of this patent is extended or adjusted under 35 U.S.C. 154(b) by 0 days.

(21) Appl. No.: 17/821,241

(22) Filed: Aug. 22, 2022

(65) Prior Publication Data

US 2023/0069373 A1 Mar. 2, 2023

Related U.S. Application Data

(60) Provisional application No. 63/236,439, filed on Aug. 24, 2021.

(51) Int. Cl.
*G08B 17/02* (2006.01)
*G08B 17/10* (2006.01)

(52) U.S. Cl.
CPC ..... *G08B 17/02* (2013.01); *G08B 17/10* (2013.01)

(58) Field of Classification Search
CPC ..... G08B 17/02; G08B 17/10
See application file for complete search history.

(56) References Cited

U.S. PATENT DOCUMENTS 4,319,229 A * 3/1982 Kirkor ..... G08B 19/005 340/517
5,671,159 A * 9/1997 Morita ..... G08B 29/24 356/433
2019/0180590 A1* 6/2019 Fischer ..... G08B 29/183
2021/0327170 A1* 10/2021 Rocholl ..... G07C 5/0816

* cited by examiner

*Primary Examiner* — Ojiako K Nwugo
(74) *Attorney, Agent, or Firm* — Rosenberg, Klein & Lee

(57) ABSTRACT

A smoke detector system includes a shielding structure enclosing a smoke detector, smoke detector circuit board or other contents. The shielding structure seals the contents from smoke, exhaust gasses, dust, chemicals, moisture, insects and other airborne particulates. The shielding structure is maintained sealed by a thermal bolt containing a thermal element which changes its state at a threshold temperature indicative of a developing fire and breaks the sealing of the shielding structure once the predetermined temperature has been reached. A lid of the shielding structure is held in place against a mounting plate by the thermal bolt. When the thermal bolt reaches the threshold temperature, it loses the integrity and allows the lid separation from the mounting plate to automatically open the shielding structure, thus allowing an internally mounted smoke detector or smoke detector circuit board to monitor the presence of smoke.

18 Claims, 23 Drawing Sheets

COMBINED HEAT-SMOKE DETECTOR WITH A SHIELDING CONTROLLED BY A THERMAL BOLT CONTAINING A THERMAL ELEMENT CHANGING ITS STATE AT A THRESHOLD TEMPERATURE

CROSS-REFERENCE TO RELATED APPLICATIONS

This Utility Patent Application is related to a Provisional Patent Application Ser. No. 63/236,439 filed on 24 Aug. 2021.

FIELD OF THE INVENTION

The present invention relates to fire and smoke detection, and particularly, to prevention of a smoke detector from exposure to smoke, exhaust gases, dust, chemicals, moisture, insects and other airborne particulates until a threshold temperature indicative of a developing fire has been reached, and once that threshold temperature has been reached, actuating the smoke detector's operation to detect the presence of smoke in the air.

The present invention additionally addresses the shielding of a garage mounted smoke detector which automatically ends when the ambient air temperature reaches a threshold temperature that is above the normal temperature range of the garage and is indicative of a developing fire. A garage mounted smoke detector that is shielded until a threshold temperature is reached would operate as a combined heat detector and smoke detector, giving a resident of a dwelling or occupant of a commercial building a very high level of confidence of a developing fire in their garage should the smoke detector ever alert.

The present invention is also directed to smoke detectors for installation in locations including residential garages, car ports, machine shops, commercial automotive service centers, manufacturing plants and other structures both residential and commercial in which the installation of smoke detectors is currently not feasible or not recommended, where smoke detectors are manufactured with a shielding from exhaust gases, smoke, airborne dust and dirt, moisture, insects, other airborne particulates and moderate temperature swings which is deactivated when a threshold temperature indicative of a developing fire has been reached, and which permits the smoke detector to monitor for the presence of smoke, once the threshold temperature indicative of a developing fire has been reached.

The present invention is further directed to smoke detectors operating with a reduced time response to the smoke/fire situation to warn the residents of a dwelling or occupants of a commercial space of a developing fire within an attached garage, car port, attic, storage space, workshop, and other non-living areas of a dwelling or a commercial property.

Furthermore, the present invention addresses the controllable shielding both of battery operated and hard-wired smoke detectors or smoke detector circuit boards.

The present invention also addresses a combined heat-smoke detector configured with a thermal case shielding the detector and a thermal bolt coupled to the shielding thermal case and containing a thermal element which changes its state at a threshold temperature, where the threshold temperature is controlled by replacing either the thermal element contained in the thermal bolt or by replacing the thermal bolt in its entirety.

BACKGROUND OF THE INVENTION

According to statistics published by the United States Fire Administration in the report "Residential Building Garage Fires (2009-2011)", there are approximately 6,600 residential garage fires annually in the United States each year which result in 30 deaths, 400 injuries and $457 million in property losses (not adjusted for inflation). The report states "In fact, the National Association of State Fire Marshals (NASFM) specifies that smoke alarms should not be installed in garages because, in general, garages are not temperature controlled; therefore, they are sometimes above or below the temperature range for which the smoke alarm was designed. Additionally, vehicle exhaust fumes will cause nuisance alarms and may lead to degradation in smoke alarm performance. For these reasons, few, if any, codes require smoke alarms in garages in one- and two-family residential buildings, where 93 percent of garage fires occurred. As a result, very few garages have smoke alarms installed."

During the past decade, several residential alarm companies developed battery operated smoke detectors that connect wirelessly to an alarm base station, and via the alarm base station to a central monitoring facility. Like wired smoke detectors, battery operated smoke detectors wirelessly connected to an alarm system via a base station, when activated by smoke or rise in temperature, can trigger audible alarms of other smoke detectors connected to the same wireless alarm system as well as the alarm system interior and exterior sirens if present. Despite their improvements, the installation of these newer, centrally monitored, wireless smoke detectors in residential garages is still not recommended.

Heat detectors, which are an alternative to smoke alarms, are generally A/C powered. When installed in a residential garage, heat detectors generally require a permanent hard-wired connection to the home's electrical system and wired smoke detector alarm circuit to alert residents of a developing fire in the garage. As existing smoke detector alarm circuits are often not present in existing (old construction) residential garages, the post-construction installation of heat detectors within an existing garage requires the extension of a home's wired smoke detector alarm circuit into the garage, increasing the installation expenses of the homeowner. As a result, heat detectors are not commonly installed in residential garages post-construction of the residence.

A heat detector or smoke detector installed in a residential garage and not connected to either the home's hard wired smoke detector alarm circuit or wireless alarm system base station is not loud enough to be heard within the sleeping area of a residence and to awaken sleeping homeowners due to the garage walls, floors, ceilings and always closed interior garage doors significantly reducing the audible alarm's decibel level within the residence. A heat detector or smoke detector that cannot be heard by the occupants of a dwelling, which is incapable of notifying a central monitoring facility, and which is incapable of remotely activating smoke alarms and sirens within the residence when activated, is essentially useless and provides no benefit to the dwelling's residents.

Therefore, there is a need for the installation in residential garages of commonly available smoke detectors including newer battery-operated wireless models that are capable of connecting to a wireless alarm system and notifying a central monitoring station. Smoke detectors installed in residential garages however need to be installed in a manner that shields the smoke detector from the everyday exhaust gases, smoke, dust, dirt, moisture and insects normally found within a garage to prevent false activations and alerts. As certain models of smoke detectors can also be triggered by a rise in temperature, smoke detectors mounted in garages also need to be shielded from the wider temperature ranges that normally exist within a garage. Being that a shielded smoke detector is incapable of being triggered by the smoke of a developing fire, the shielding of a garage mounted smoke detector needs to automatically end when the ambient air temperature reaches a threshold temperature that is above the normal temperature range of the garage and indicative of a developing fire. A garage mounted smoke detector that is shielded until a threshold temperature is reached would therefore desirably act as a combined heat detector and smoke detector, giving a resident of a dwelling or occupant of a commercial building a very high level of confidence of a developing fire in their garage should the smoke detector ever alert.

Numerous technologies have been developed for smoke detection and fire protection. For example, U.S. Pat. Nos. 10,272,278, 8,714,180, and 8,402,985 address improvements made to thermal elements which are in the form of a liquid filled glass ampoules to lessen the time it takes for a thermal element to rupture for activation of fire sprinklers. These thermal elements are however not used for the purpose of shielding a smoke detector.

U.S. Pat. No. 1,000,717 describes a sprinkler head that uses a thermal element in the form of a liquid filled glass ampoule. The thermal element is under compression, with one end of the thermal element supported by a frame of the sprinkler head and the other end supported by a plug. A lever holds back the water which is being supplied to the sprinkler head body. The prior art thermal element however is neither considered to be embedded in a thermal bolt in a smoke detector, nor to be under tension to pull the head and core of a thermal bolt together.

U.S. Pat. No. 9,233,266 describes a sprinkler head that uses a fusible link with the purpose of the fusible link to restrain components that hold a plug in a sprinkler head orifice, blocking the flow of water until the fusible link reaches its melting (or separation) temperature, allowing the blocking water plug to be dislodged. The system addressed in the '266 patent however does not teach a thermal bolt containing a fusible link as the thermal element with the fusible link captured and tensioned by a tensioner structure.

U.S. Pat. Nos. 6,522,254 and 6,057,774 address smoke detectors with screening and emphasize the need for protecting the sensor of a smoke detector from insects, dust and other airborne contaminants other than those found in smoke. These smoke detectors however allow damaging chemicals to pass through the dust and insect screens, and do not address an ability to block the sensor of a smoke alarm system from all airborne contaminants including smoke, dust, moisture, corrosive chemicals, insects, etc. until a threshold temperature is reached at which time all airborne contaminants may reach the smoke detector sensor without undermining its functionality.

It is therefore desirable to provide a technology which would overcome the deficiencies of the prior art by providing a smoke detector having a sensor sealed within a thermal case which would not become clogged while the smoke sensor/alarm is mounted and sealed within the thermal case, and which would be capable of completely shielding the smoke detector from exposure to airborne chemicals damaging to a smoke detector sensor.

In addition, the prior art smoke detectors allow smoke to be detected without a preceding rise in temperature, which makes them unusable in areas where the use of smoke detectors is currently prohibited or impractical. It thus would be highly desirable to expand the smoke detecting capabilities into spaces that are currently unmonitored, such as, for example, residential garages, car ports, machine shops, commercial automotive service centers, manufacturing plants. Therefore, a modernized smoke detection technology would be highly desirable which would require a rise in temperature indicative of a developing fire prior to exposure of the smoke detector to the air external to the thermal case, thus extending the amount of time required before the smoke detector reacts to the presence of smoke in the air.

SUMMARY OF THE INVENTION

It is therefore an object of the present invention to provide smoke detectors shielded from exhaust gases, smoke, airborne dust and dirt, moisture, insects, other airborne particulates and moderate temperature swings, allowing smoke detectors to be installed in locations such as residential garages, car ports, machine shops, commercial automotive service centers, manufacturing plants and other structures both residential and commercial in which the installation of smoke detectors is currently not feasible or recommended.

It is another object of the present invention to provide smoke detectors shielded from exhaust gases, smoke, airborne dust and dirt, moisture, insects, other airborne chemicals and particles, and moderate temperature swings until a threshold temperature indicative of a developing fire has been reached.

It is an additional object of the present invention to provide a smoke detector with a shielding which is deactuated once a threshold temperature has been reached in the smoke detector's surrounding, thus protecting the smoke detector from various contaminants prior to raising surrounding temperature to a threshold value, and transforming the operation of the smoke detector to a monitoring mode to monitor for the presence of smoke, once a threshold temperature indicative of a developing fire has been reached.

It is also object of the present invention to minimize time it takes residents of a dwelling or occupants of a commercial space to become aware of a developing fire within an attached garage, car port, attic, storage space, workshop, other non-living area of a dwelling or commercial property.

It is an additional object of the present invention to shield both battery-operated and hard-wired smoke detectors or smoke detector circuit boards.

Furthermore, it is an object of the present invention to provide a smoke detector which does not require maintenance procedure other than a periodic light cleaning, or in the case where the smoke detector incorporates a smoke detector circuit board, a periodic testing of the smoke detector circuit board and periodic battery replacement may be required.

In addition, it is an object of the present invention to provide a smoke detector with a changeable threshold temperature (at which the shielding changes its status from the shielding mode to a smoke monitoring mode) by replacing either a thermal element embedded in the thermal bolt used by the thermal case, or by replacing the thermal bolt in its entirety.

The present smoke detector system is advantageous over the conventional smoke detectors in that the material shielding the subject smoke detector sensor cannot become clogged while the smoke alarm is mounted and sealed within a thermal case. In a developing fire when the lid of the thermal case falls free of the mounting plate exposing the smoke detector, the period of time between the case opening and the smoke alarm detecting the presence of smoke is typically so short that the possibility of the smoke alarm sensor screening material becoming clogged before the smoke detection is nearly non-existent.

Another advantage of the subject system over conventional smoke detectors is that airborne chemicals capable of damaging a smoke detector sensor are completely shielded in the present smoke detectors, whereas the conventional smoke detectors allow corrosive chemicals to pass through the dust and insect screens, thus damaging the smoke detector sensor.

The present smoke detecting system requires a rise in temperature indicative of a developing fire before a smoke detector enclosed in a thermal case is exposed to the surroundings (external to the thermal case), thus extending the time duration required before the enclosed smoke detector can react to the presence of smoke in the air. Conventional smoke detectors detect the smoke and trigger the alarm without a preceding rise in temperature which makes them applicable in residential living areas or other areas where rapid smoke detection is required. Instead, the subject system is intended to be used in areas where the use of conventional smoke detectors is currently prohibited or impractical, expanding smoke detecting capabilities of the present system into spaces that are currently unmonitored, such as residential garages, car ports, machine shops, commercial automotive service centers, and manufacturing plants.

A preferred embodiment of the present smoke detector comprises a thermal bolt and a thermal case containing an embedded smoke detector, smoke detector circuit board and other contents.

The thermal bolt is envisioned as a threaded bolt comprising a threaded core and a bolt head which are held in place by a tensioner, and a thermal element embedded in the threaded bolt. The thermal element serves as a heat detector and is capable of changing its state once a temperature reaches a level indicative of a developing fire. In one embodiment, the threaded core is configured with interior and exterior threads. One end of the thermal element is captured by the bolt head, and the other end of the thermal element is captured by the tensioner. As the tensioner is screwed into the interior threads of the threaded core, both the thermal element and bolt head are pulled towards the threaded core until the bolt head is compressively held in place, interlocked with the threaded core, and all components of the thermal bolt are interlocked together allowing the thermal bolt to function as a typical bolt.

The present system includes a thermal case (also referred to herein as a shielding structure) in the form of a housing that includes a lid and a mounting plate to enclose a smoke detector and/or the smoke detector's circuit board, or other components required for proper functioning of the present smoke detector system. An internal bridge, attached at each end to the mounting plate, spans internally across the lid and has, at its midpoint, a threaded hole aligned with a hole in the lid.

The thermal bolt screws into the internal bridge's threaded hole via the hole in the center of the lid. While the ambient temperature remains below the thermal bolt's threshold temperature rating, the thermal bolt holds the lid in compression against the mounting plate, thus shielding the contents of the thermal case from air, dust, smoke, moisture, insects, etc. external to the thermal case. When a thermal case is mounted to a ceiling or bottom side of other horizontal mounting surfaces, with the mounting plate's outer surface flush with the ceiling or a horizontal surface, the internal bridge and the thermal bolt prevent the lid from falling down from the mounting plate under the force of gravity.

During the fire development, as the smoke and heat rise, the thermal element of the thermal bolt experiences rise in temperature. When the thermal element reaches its threshold temperature and ruptures, melts or separates (depending upon its composition), the bolt head separates from the threaded core, and the bolt head and lid both fall free under the force of gravity to expose the thermal case's contents to the smoke that has risen towards the ceiling. If a smoke detector or smoke detector circuit board is mounted within the thermal case, the smoke detector upon being exposed to and detecting the smoke from the developing fire sounds an audible alarm, flashes a visible alarm if capable, and if so equipped, wirelessly transmits an alert signal to an alarm base station, or to other smoke detectors via the hard-wired central smoke detector alarm circuit.

DETAILED DESCRIPTION OF THE INVENTION

Figure 1A:
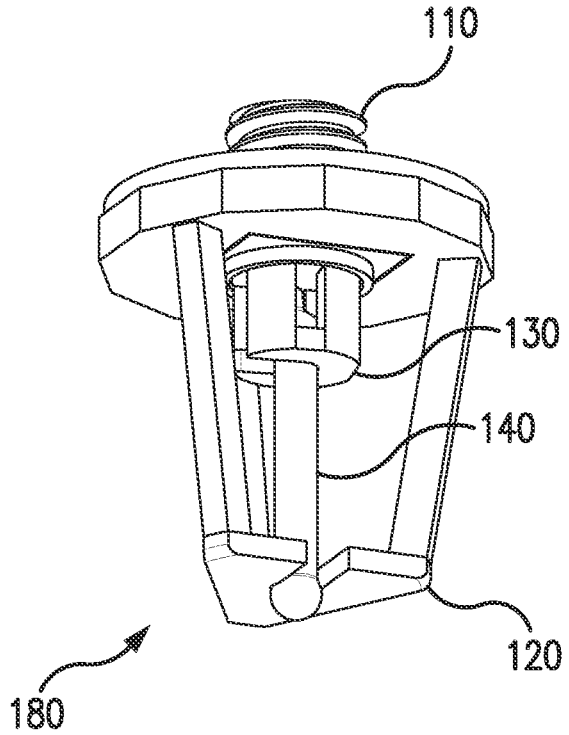
FIG. 1A depicts the subject thermal bolt in its assembled state with the thermal element captured by the bolt head.
Figure 1B:
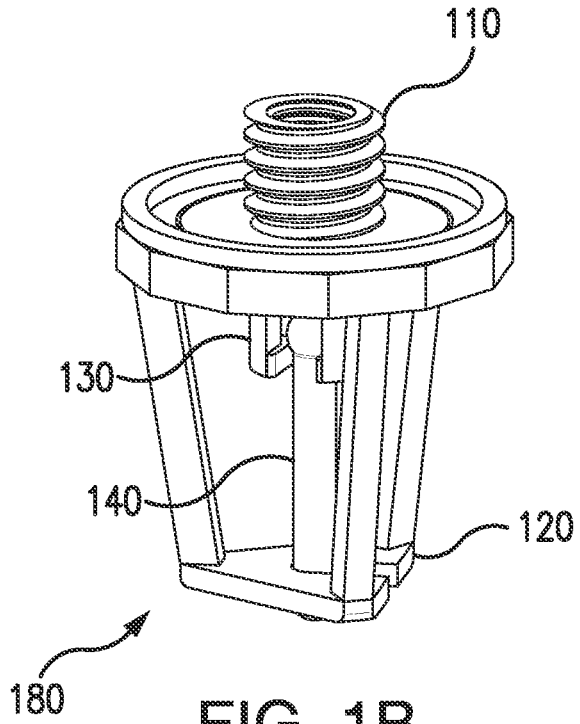
FIG. 1B shows the subject thermal bolt in its assembled state with the thermal element captured by the tensioner.
Figure 1C:
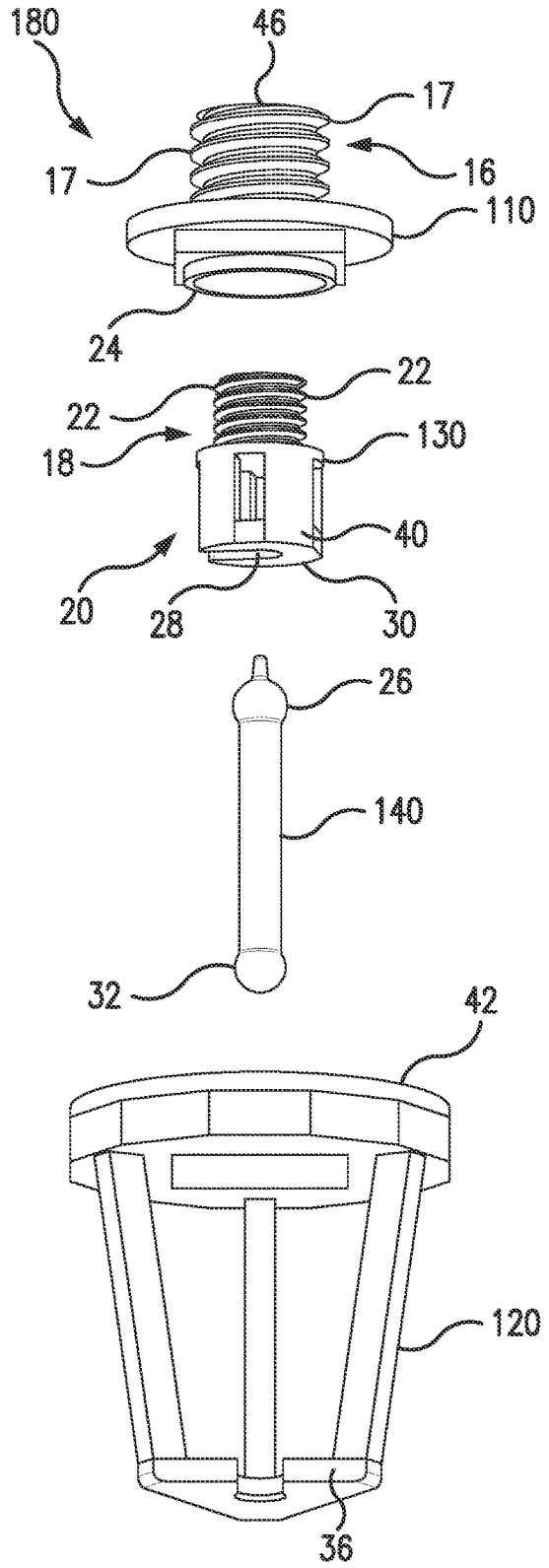
FIG. 1C is an exploded view of the subject thermal bolt with the thermal element support structure of the bolt head visible.
Figure 1D:
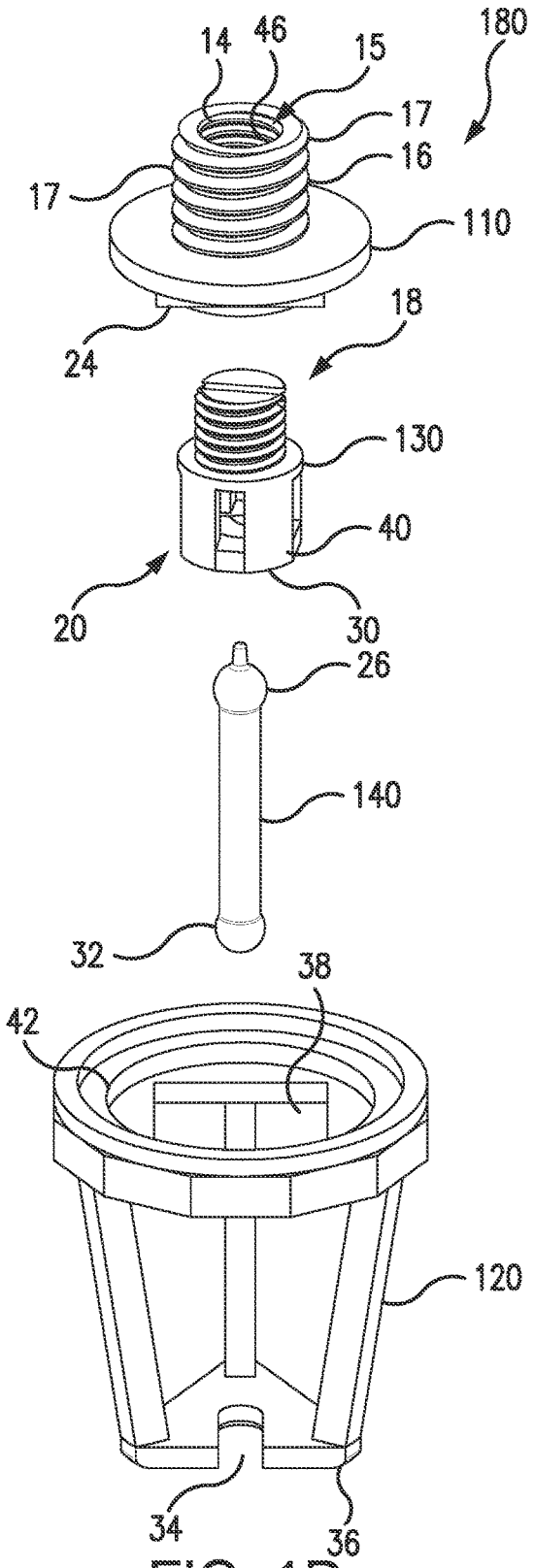
FIG. 1D is an exploded view of the subject thermal bolt with the tensioning feature end of the tensioner visible.
Figure 1E:
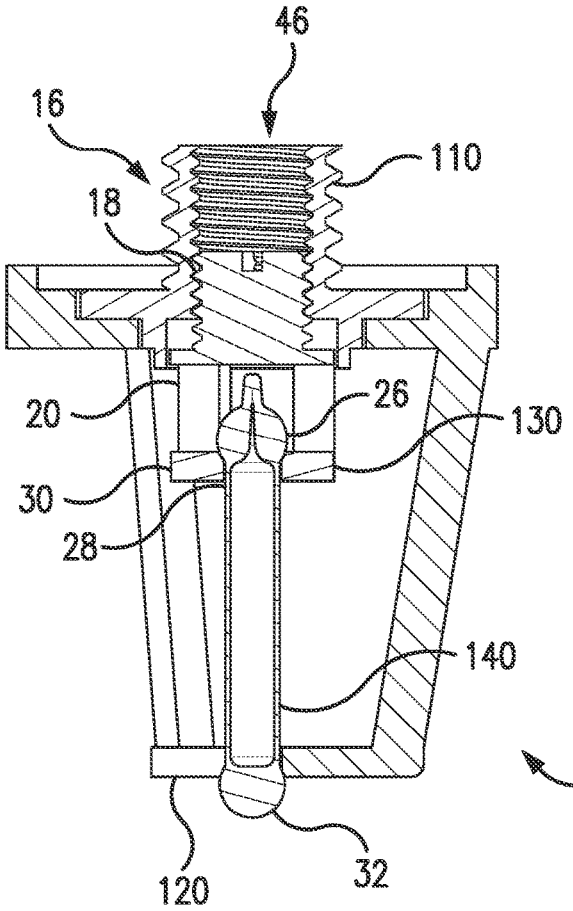
FIG. 1E is a longitudinal cross-sectional view of the subject thermal bolt.
Figure 1F:
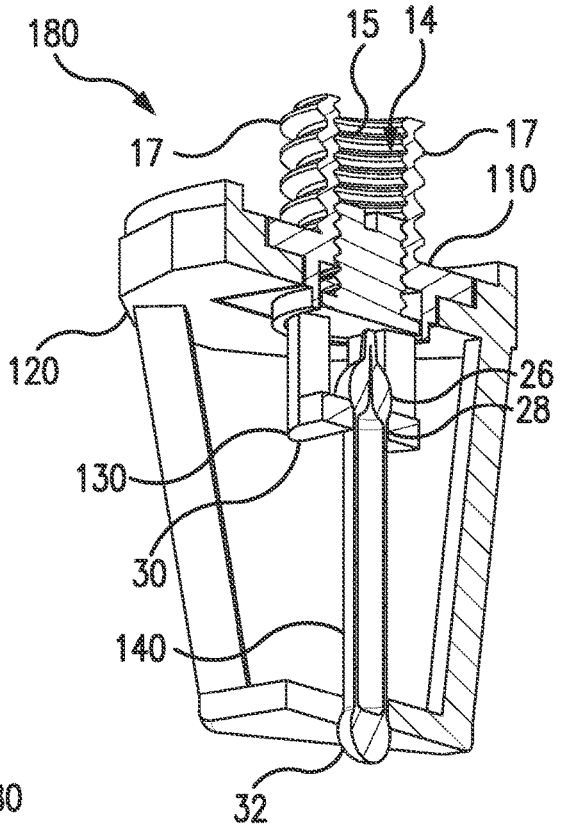
FIG. 1F is a longitudinal cross-sectional view of the assembled thermal bolt with the mating interface of the threaded core and bolt head visible, and the capture of the thermal element by both the tensioner and bolt head visible.
Figure 1G:
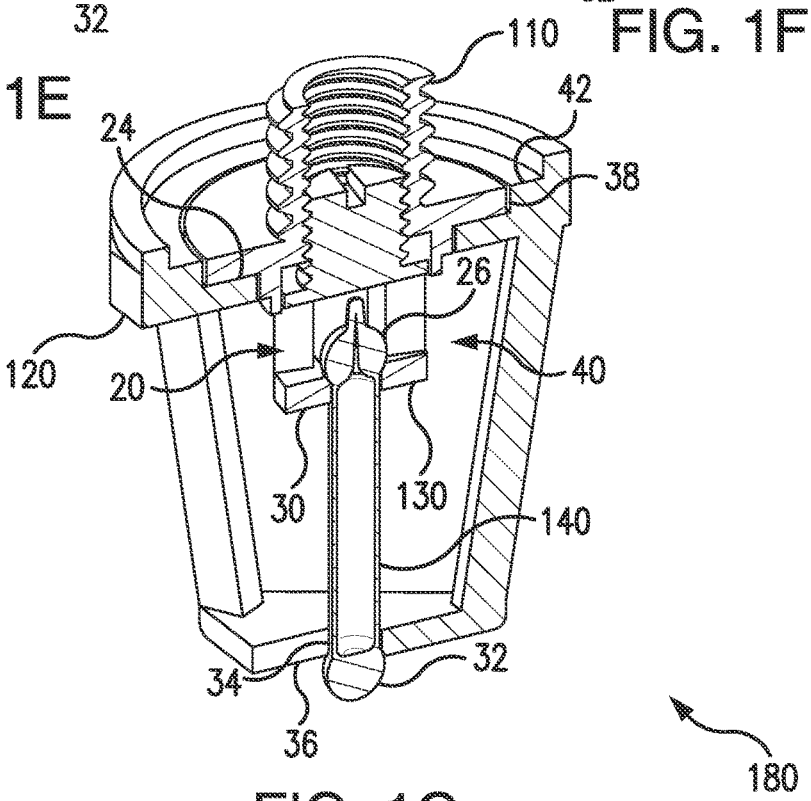
FIG. 1G shows a cross sectional view of the assembled thermal bolt with the threaded end of the threaded core visible.

Referring to FIGS. 1A-7G, the present smoke detector system 10 includes a smoke detector 200 incorporated into and protected by a shielding structure (also referred to herein as a screening structure or a thermal case) 44, and a thermal bolt unit 180. The shielding structure 44 in the present system 10 can operate in two operational states, including (a) a closed (protective) mode of operation and (b) an activated (smoke detection/alarm) mode of operation. The thermal bolt 180 controls the transformation of the shielding structure 44 between the operational states of the shielding structure 44, i.e., whether the shielding structure maintains its wholeness to protect the smoke detector 200 from the environmental matters or is collapsed to expose the smoke detector 200 to the surroundings, as is detailed in the following paragraphs.

Referring to FIGS. 1A-1G, the thermal bolt 180 is composed of a threaded core 110 and a bolt head 120 which, when assembled, presses against and interlocks with the threaded core 110. The threaded head 110 is threaded both on its interior cylindrical surface 14 and exterior cylindrical surface 16 to form interior threads 15 and exterior threads 17, respectively.

The thermal bolt 180 further includes a tensioner 130, which includes a threaded portion 18 and a non-threaded portion 20. The threaded portion 18 of the tensioner 130 is externally threaded to form external threads 22 having a thread pitch that matches the thread pitch of the interior threads 15 on the interior surface 14 of the threaded core 110. The threaded portion 18 of the tensioner 130 is inserted, though the mating interface end 24 of the threaded core 110, into the threaded core 110 for a threading engagement between the interior threads 15 formed on the interior cylindrical surface 14 of threaded core 110 and the external threads 22 of the tensioner 130.

The thermal bolt 180 further includes a thermal element 140 which is embedded within the thermal bolt 180. The thermal element 140 serves as a heat sensor, and changes its state (ruptures, collapses, or melts) once it is exposed to a threshold temperature the value of which is indicative of a developing fire.

One end 26 of the thermal bolt 140 is captured in place by a capturing opening 28 fabricated on the bottom 30 of the non-threaded portion 20 of the tensioner 130. An opposite end 32 of the thermal element 140 is engaged in the indentation 34 formed in the bottom 36 of the bolt head 120, which is distal to the threaded core 110.

As the threaded portion 18 of the tensioner 130 is inserted (screwed) into the threaded core 110, the tensioner 130 pulls the thermal element 140 towards the threaded core 110. At the same time, the thermal element 140 which is exposed to the tension force, pulls the bolt head 120 towards the threaded core 110, pushing the mating interface end 24 of threaded core 110 into the mating interface 38 of the bolt head 120, thus interlocking the bolt head 120 and the threaded core 110.

The non-threaded portion 22 of the tensioner 130 is configured with features 40 that allow a screwdriver or other tool (not shown in the Drawings) to be used to tighten the tensioner 130 as it is advancing into the threaded core 110.

The subject smoke detector system 10 uses tensile forces applied to the thermal element 140 by the tensioner 130 when it is inserted into and threadedly engaged with the threaded core 110 to be applied to the bolt head 120, keeping the bolt head 120 compressed against the threaded core 110. The mating interfaces 24 and 38 of the threaded core 110 and the bolt head 120, respectively, are shaped in a manner that allows the threaded core 110 to interlock with the bolt head 120, thus holding the threaded core 110 perpendicular to the face 42 of the bolt head 120, and allowing for the passage of the tensioner 130 though the bolt head 120 mating interface 38, while permitting rotational forces applied to the bolt head 120 to be transmitted to the threaded core 110 without rotational forces being applied to the tensioner 130 or the thermal element 140. When rotational forces applied to the bolt head 120 are transmitted to the threaded core 110, the thermal bolt 180, as an entire assembly, can be screwed into or unscrewed from a part of the subject smoke detector system 10 (as will be detailed in further paragraphs) that has threads matching the exterior threads 17 on the exterior cylindrical surface 16 of the threaded core 110. For example, such part of the smoke detector system 10 may be in the form of an internal bridge 160 of a shielding structure (also referred to herein as a thermal case) 44 shown in FIGS. 2A-FIGS. 2G and 3A-3D.

The thermal element 140 changes its state when exposed to a predetermined temperature. The thermal element 140 may rupture, melt or collapse at a predetermined temperature, referred to herein as a threshold temperature. Thermal elements, such as the thermal element 140, are known in the related art, and are not detailed herein. For example, the thermal element 140 may be in the form of a liquid filled glass ampoule typically used in residential sprinkler heads and may rupture once the surrounding temperature rises to 135, 155, 175 or 200 degrees Fahrenheit. To change the threshold temperature of the thermal bolt 180, a tool (not shown in the Drawings) may be inserted into the features 40 formed in the non-threaded portion 20 of the tensioner 130 through the threaded hole 46 of the threaded core 110 distal to the tensioner 130 to unscrew the tensioner 130 just far enough to disengage the thermal element 140 from the tensioner 130 and the bolt head 120. Subsequently, a replacement thermal element with a different threshold temperature is embedded into both the tensioner 130 and the bolt head 120 in a manner described in previous paragraphs. Once the replacement thermal element has been engaged on each end 26,32 in the proper position, the tensioner 130 is screwed back into the threaded core 110 until the replacement thermal element 140 is under the tension to pull the bolt head 120 back into compression state against and interlocking with the threaded core 110.

Figure 3A:
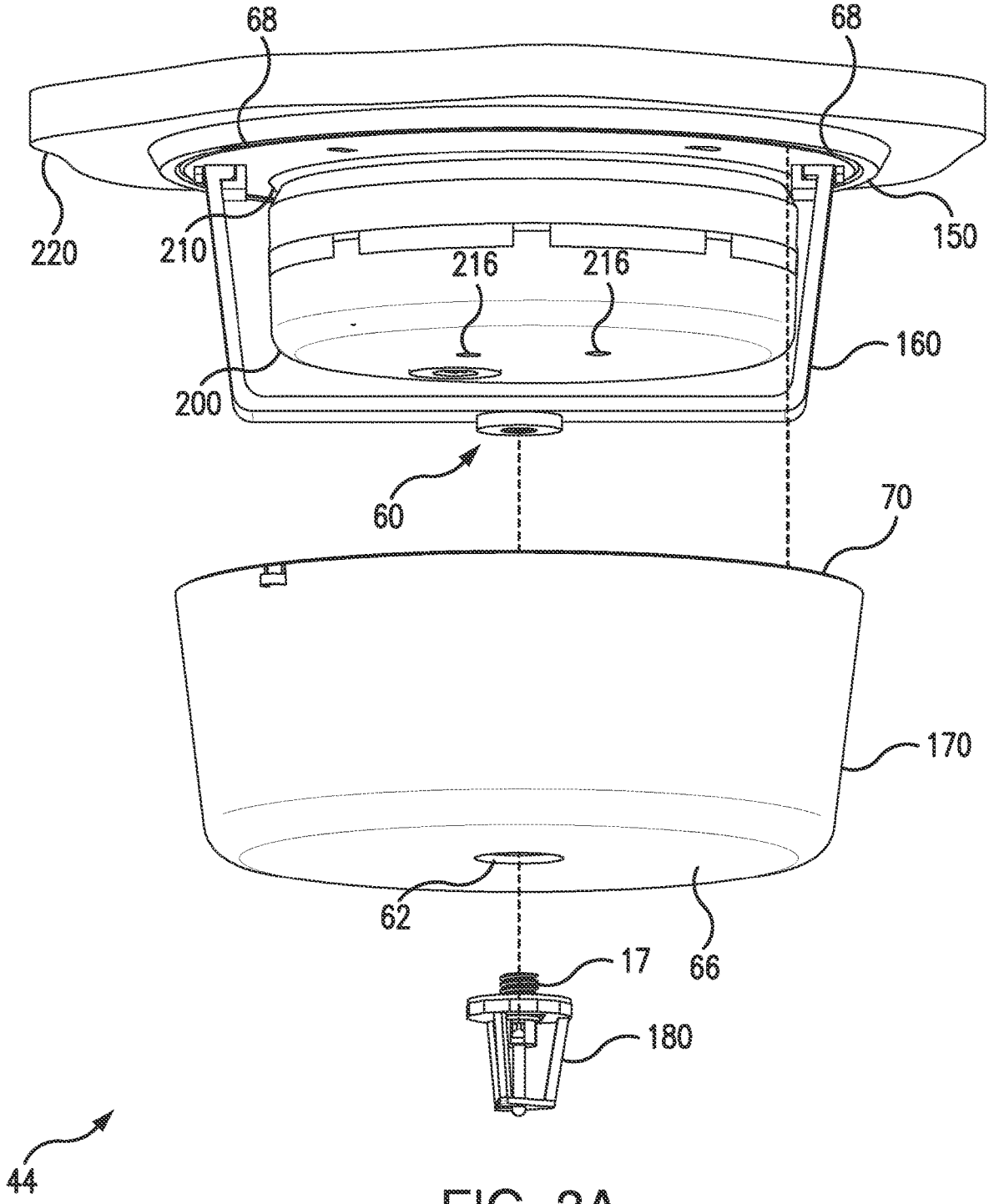
FIG. 3A is an exploded vies of the thermal case mounted on a ceiling with a smoke detector mounted inside prior to installation of the lid, thermal bolt and the safety tether.
Figure 3B:
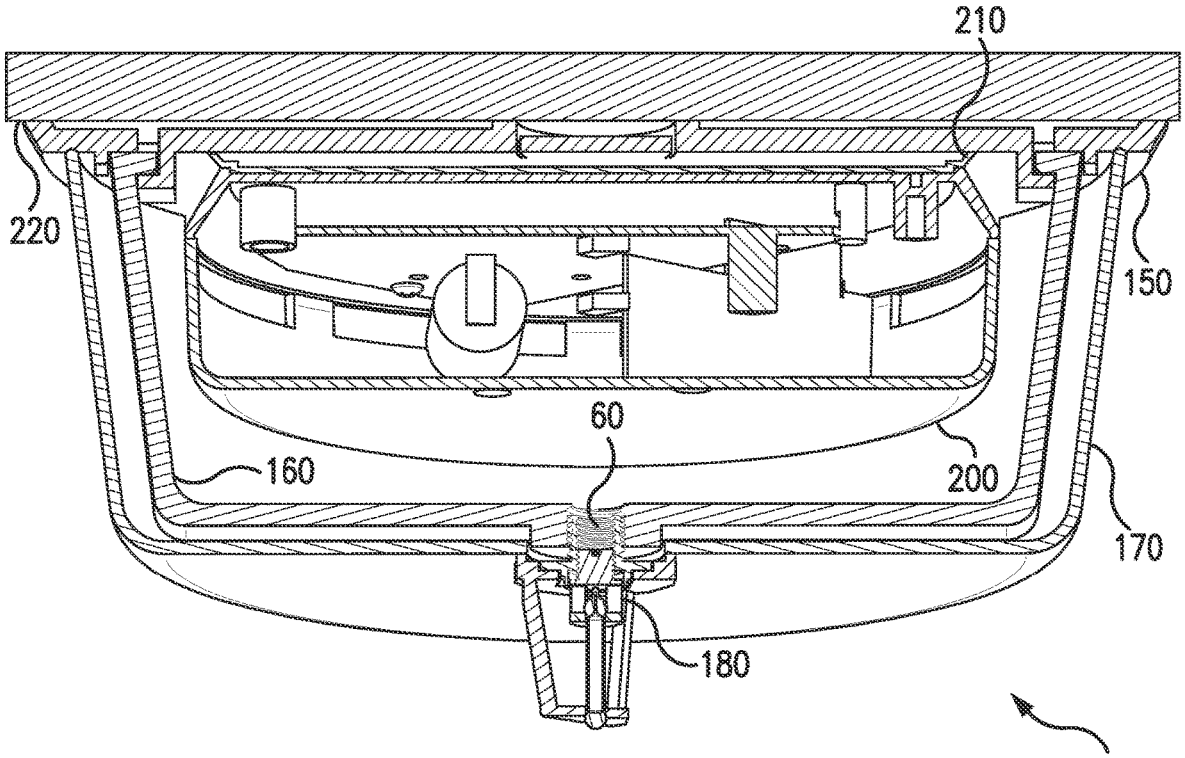
FIG. 3B depicts a cross sectional view of the assembled thermal case and thermal bolt with an enclosed smoke detector body and smoke detector mounting plate.
Figure 3C:
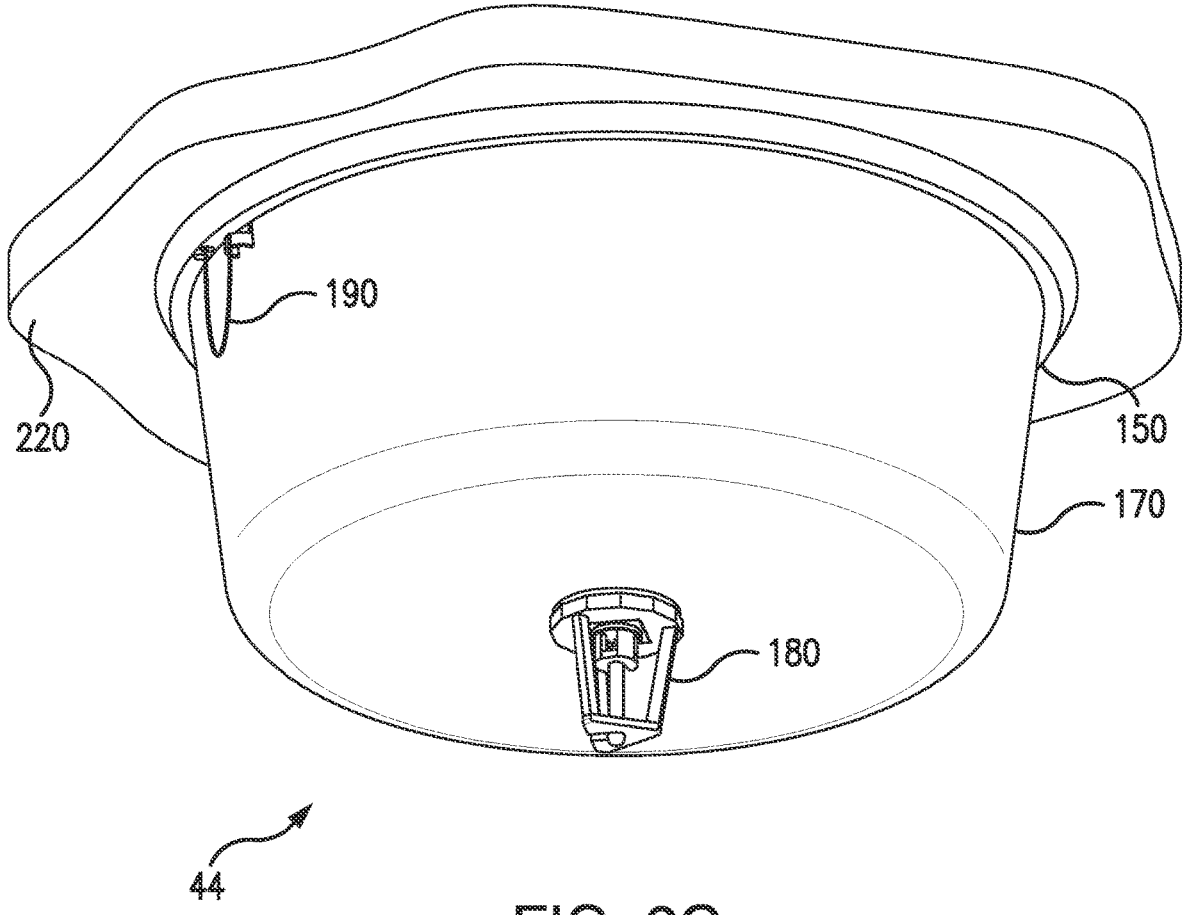
FIG. 3C shows the subject thermal case mounted to a ceiling with a smoke detector mounted inside prior to rupture of the thermal element.
Figure 3D:
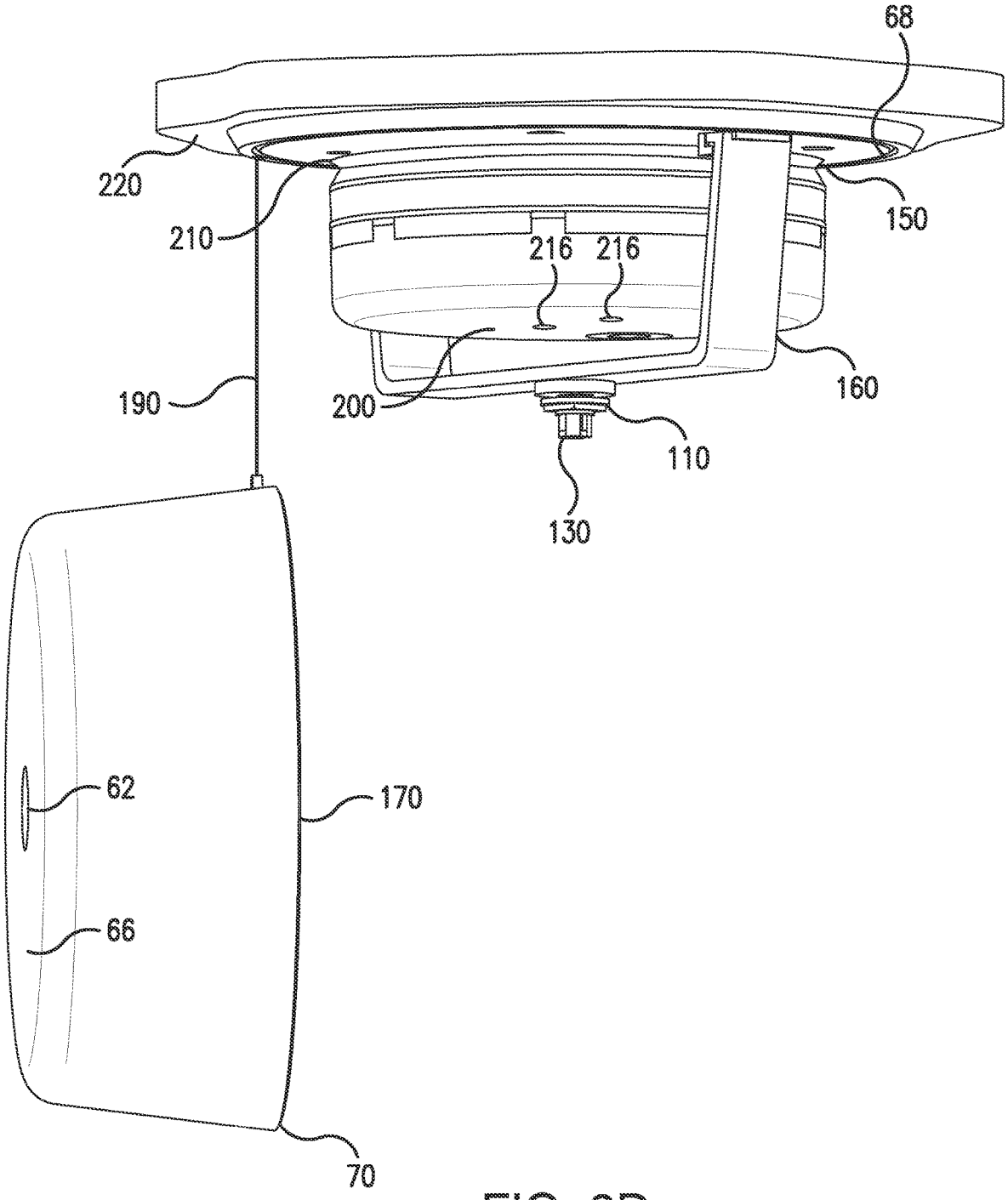
FIG. 3D shows the present thermal case mounted to a ceiling with a smoke detector mounted inside after the thermal element has ruptured, the bolt head has fallen from the thermal bolt, and the dropped lid held by the safety tether.
Figure 3E:
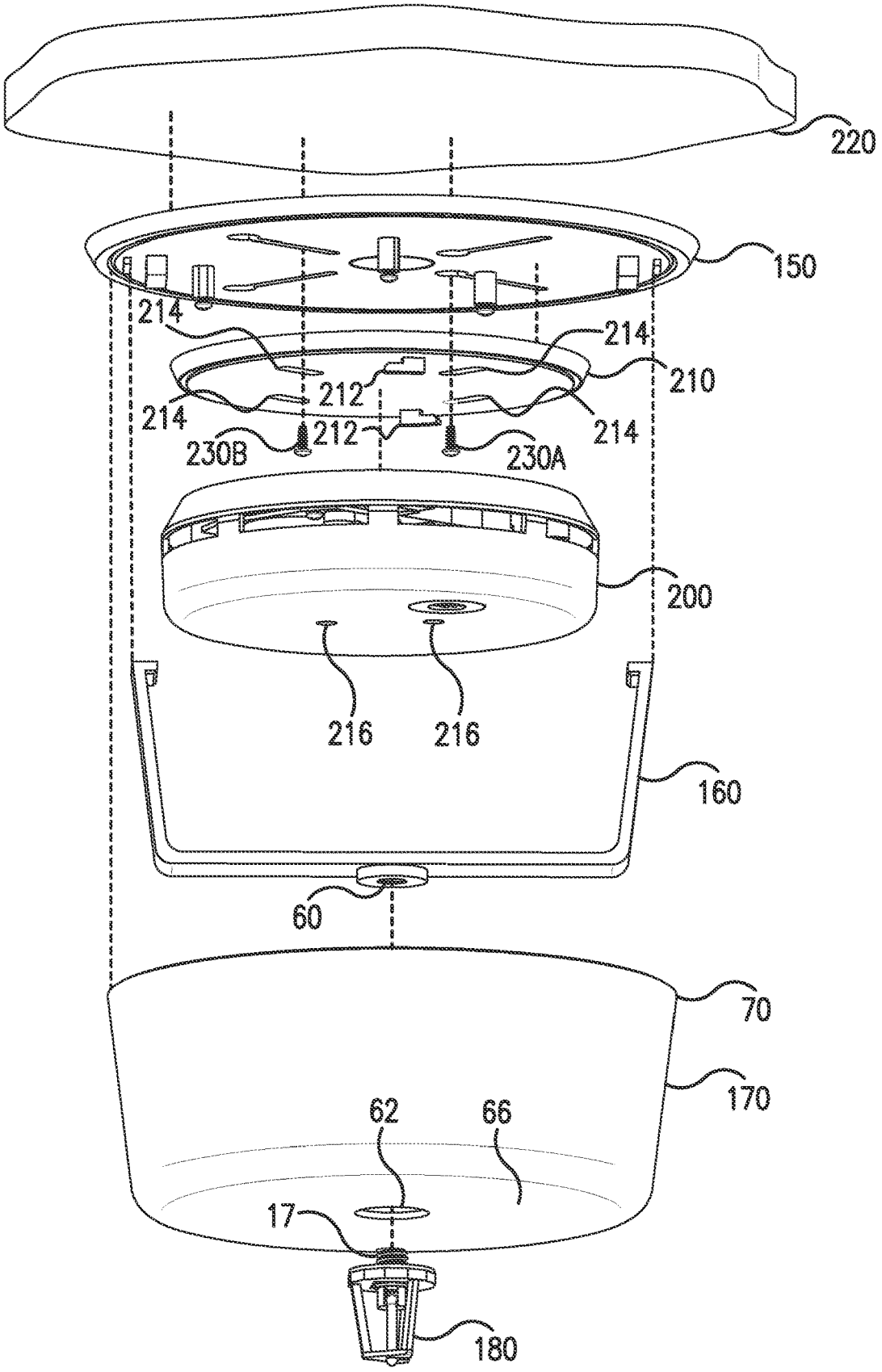
FIG. 3E is an exploded view of the subject thermal case mounted to a ceiling with an embedded smoke detector.
Figure 4:
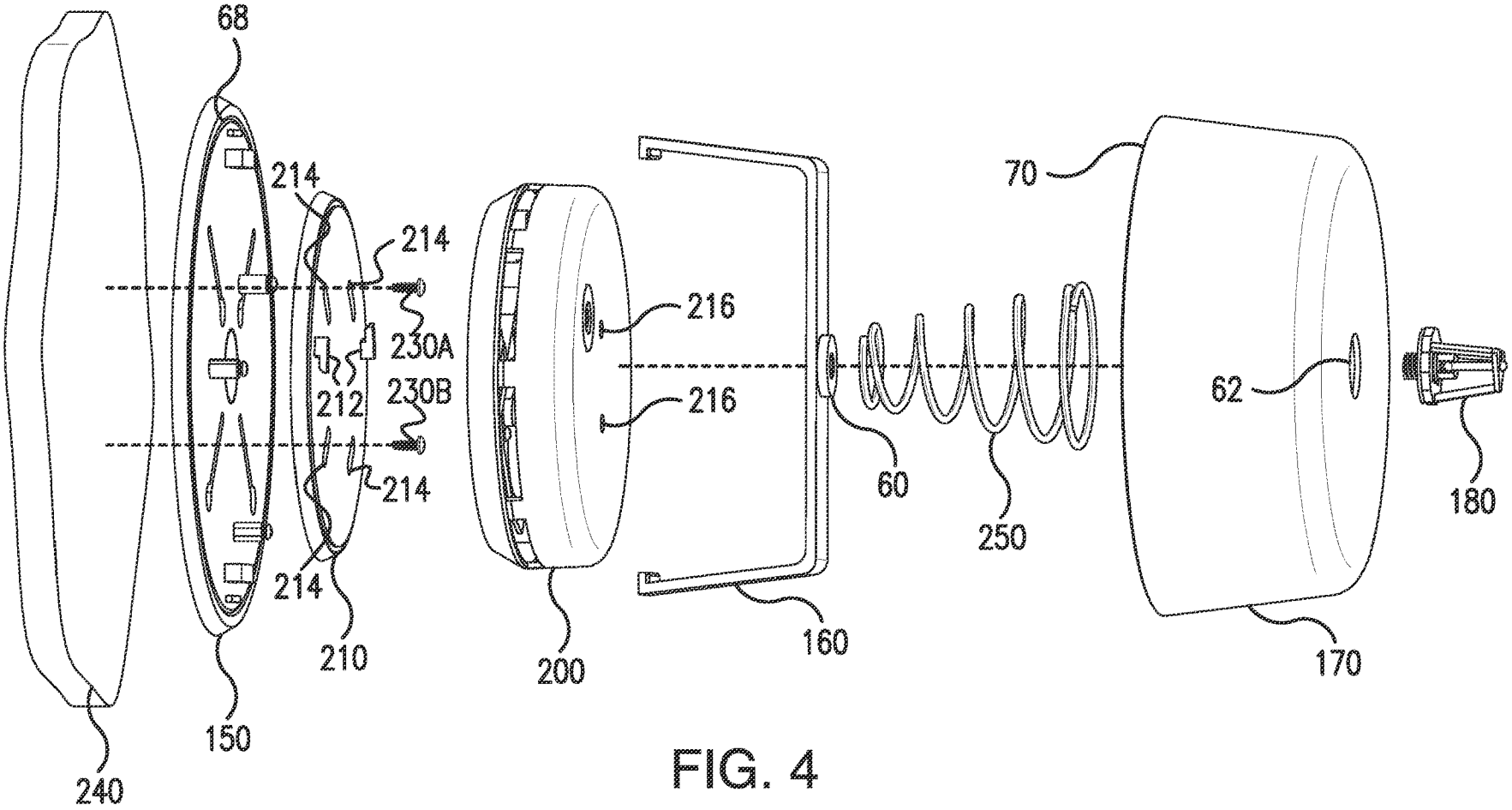
FIG. 4 depicts an exploded view of the additional embodiment of the present system with the thermal case mounted to a wall with an embedded smoke detector, and a canonical spring installed to eject the lid from the mounting plate.

The shielding structure 44 of the subject smoke detector system 10 serves as a shield (screen) for the smoke detector 200. In one of the preferred embodiments depicted in FIGS. 2A-2G and 3A-3E, the shielding structure 44 includes a mounting plate 150 and an internal bridge 160 which is secured to the mounting plate 150 via an interlocking engagement of tabs 50 formed on the mounting plate 150 with projections 52 formed at the ends 54,56 of the internal bridge 160. The mounting plate 150 is secured to a ceiling or any other horizontal mounting surface 220 (as depicted in FIGS. 3A-3E, 5, and 6B) or a vertical surface (for example a wall) 240 (as depicted in FIG. 4), thus securing the subject smoke detector system 10 at the desired location for operation. As depicted in FIGS. 3A-3B,3D-3E, and 4, the smoke detector 200 is attached to the mounting plate 150 via a smoke detector mounting plate 210 providing a coupling mechanism between the smoke detector 200 and the plate 210 in the form of locking tabs 212 cooperating with locking indentations (not shown in the Drawings) formed on the casing of the smoke detector 200, and/or the indentations 214 on the plate 210 aligned with the holes 216 formed on the casing of the smoke detector 200 for the mounting screws 230A and 230 B to pass through to couple the smoke detector 200 to the thermal case 44 through the smoke detector mounting plate 210.

The internal bridge 160 is configured with a threaded hole 60 having internal threads 58 formed therein. The external threads 17 formed on the exterior cylindrical surface 16 of the of the threaded core 110 of the thermal bolt 180 and the internal threads 58 of the threaded hole 60 configured centrally in the internal bridge 160 are matching threads.

The shielding structure 44 further includes a lid 170 which serves as the thermal case. The lid 170 is secured against the mounting plate 150 by the thermal bolt 180 which passes through a hole 62 in the center of the lid 170 and is screwed into the threaded hole 60 of the internal bridge 160.

A safety tether 190 (shown in FIGS. 2A, 3A, 3C and 6A) connects to the lid 170 and to the mounting plate 150. The hole 62 formed in the center of the lid 170 is of a sufficient diameter to easily pass over the remaining parts of the threaded core 110 of the thermal bolt 180 after the bolt head 120 separates from the threaded core 110 when the threshold temperature has been reached and the thermal element 140 has ruptured, melted or collapsed. The hole 62 formed in the center of the lid 170 however is smaller in diameter than the diameter of the bolt head 120 of the thermal bolt 180 to allow the thermal bolt 180 to secure the lid 170 while restricting air movement through the center hole 62 of the lid 170.

When the thermal bolt 180, as an assembled module, is screwed to the internal bridge 160, the threaded core 110 and the tensioner 130 of the thermal bolt 180 do not come in contact with the lid 170. Only the upper flat portion 42 of the bolt head 120 of the thermal bolt 180 contacts the lid 170 on the exterior surface 66 of the lid 170 adjacent to and around the central hole 62 of the lid 170. The thermal bolt 180, along with the internal bridge 160, apply a compressive force to the lid 170, holding the lid 170 in place against the mounting plate 150, thus sealing the contents of the shielding structure 44, including the smoke detector 200 (as shown in FIGS. 3A-3C) and/or the smoke detector circuit board 270 (depicted in FIG. 6B).

Figure 2A:
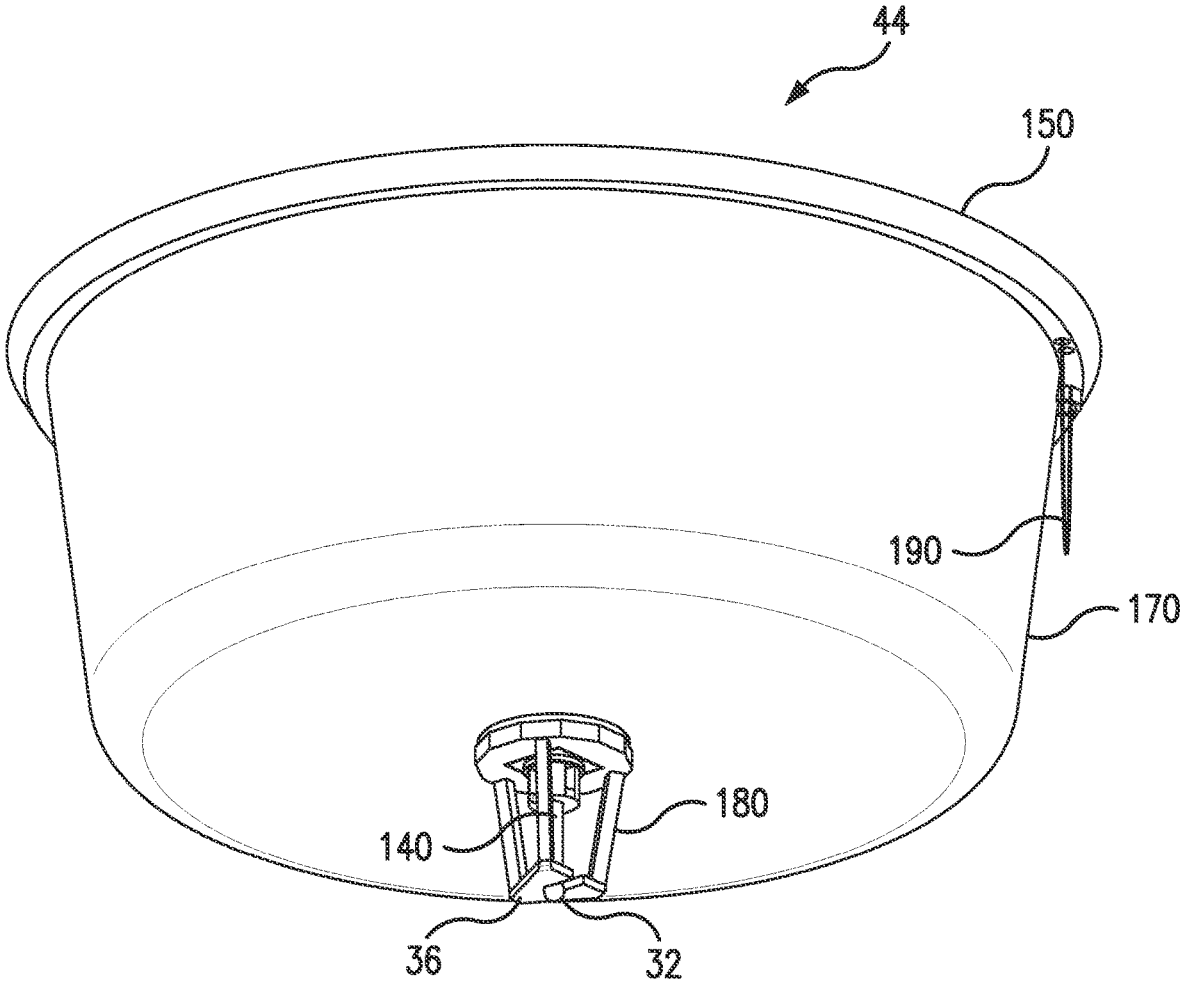
FIG. 2A is an external view of the subject thermal case in its assembled state.
Figure 2B:
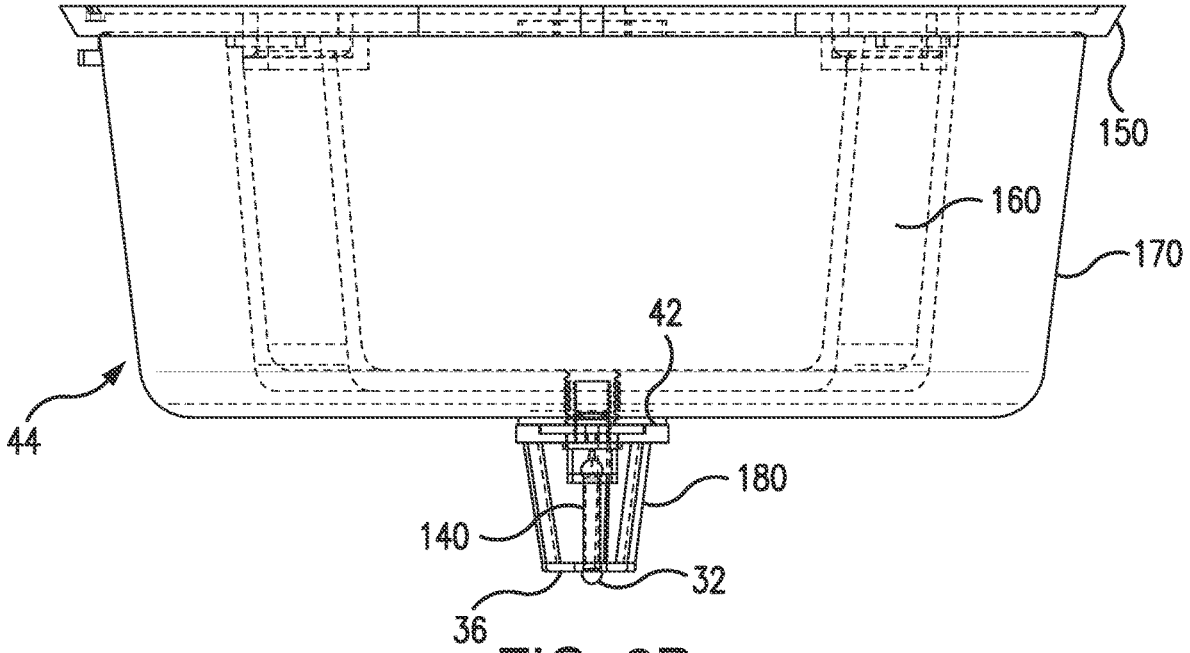
FIG. 2B shows the thermal case in its assembled state detailing the internal features.
Figure 2C:
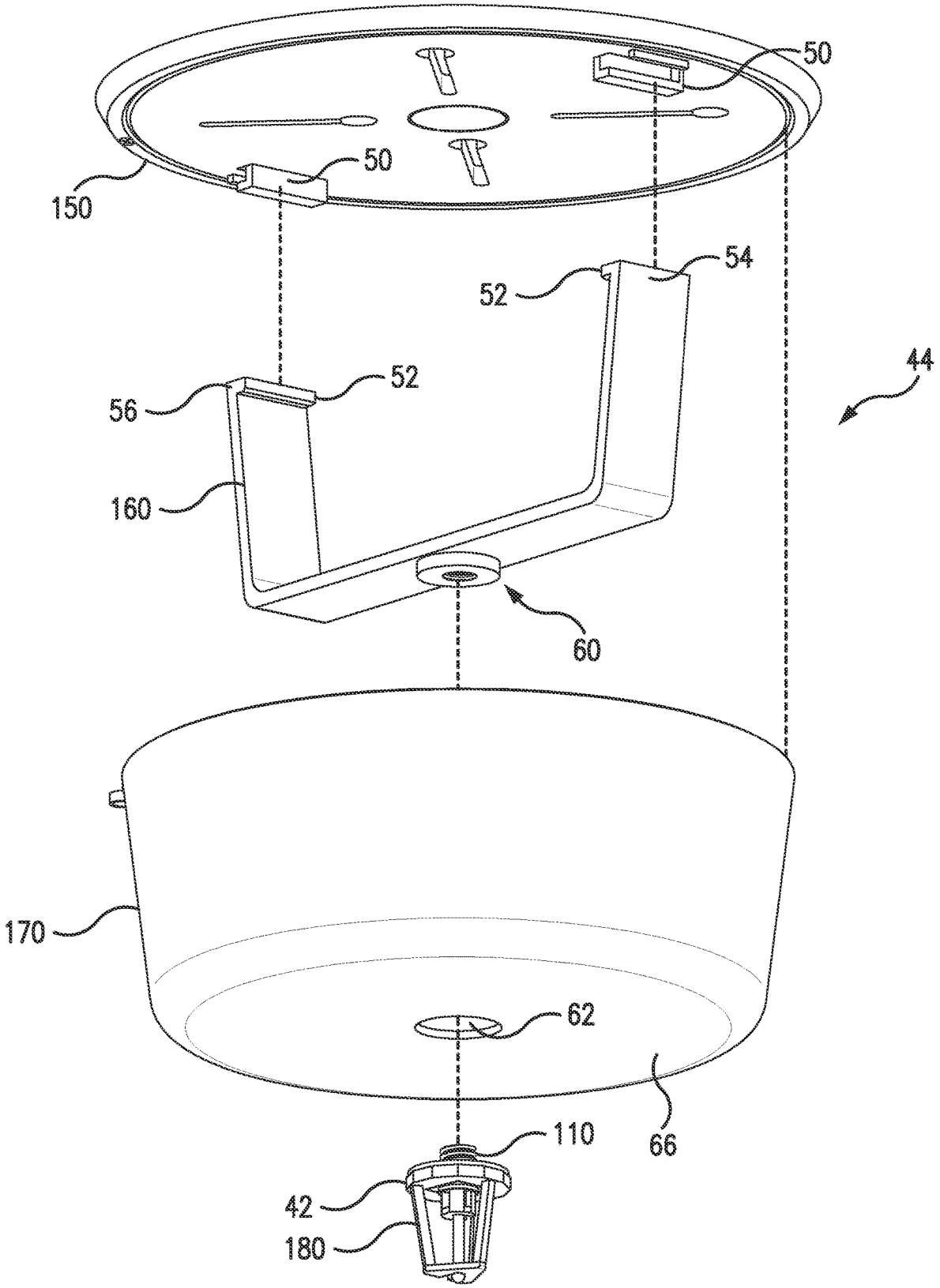
FIG. 2C is an exploded view of the present thermal case with the assembled thermal bolt.
Figure 2D:
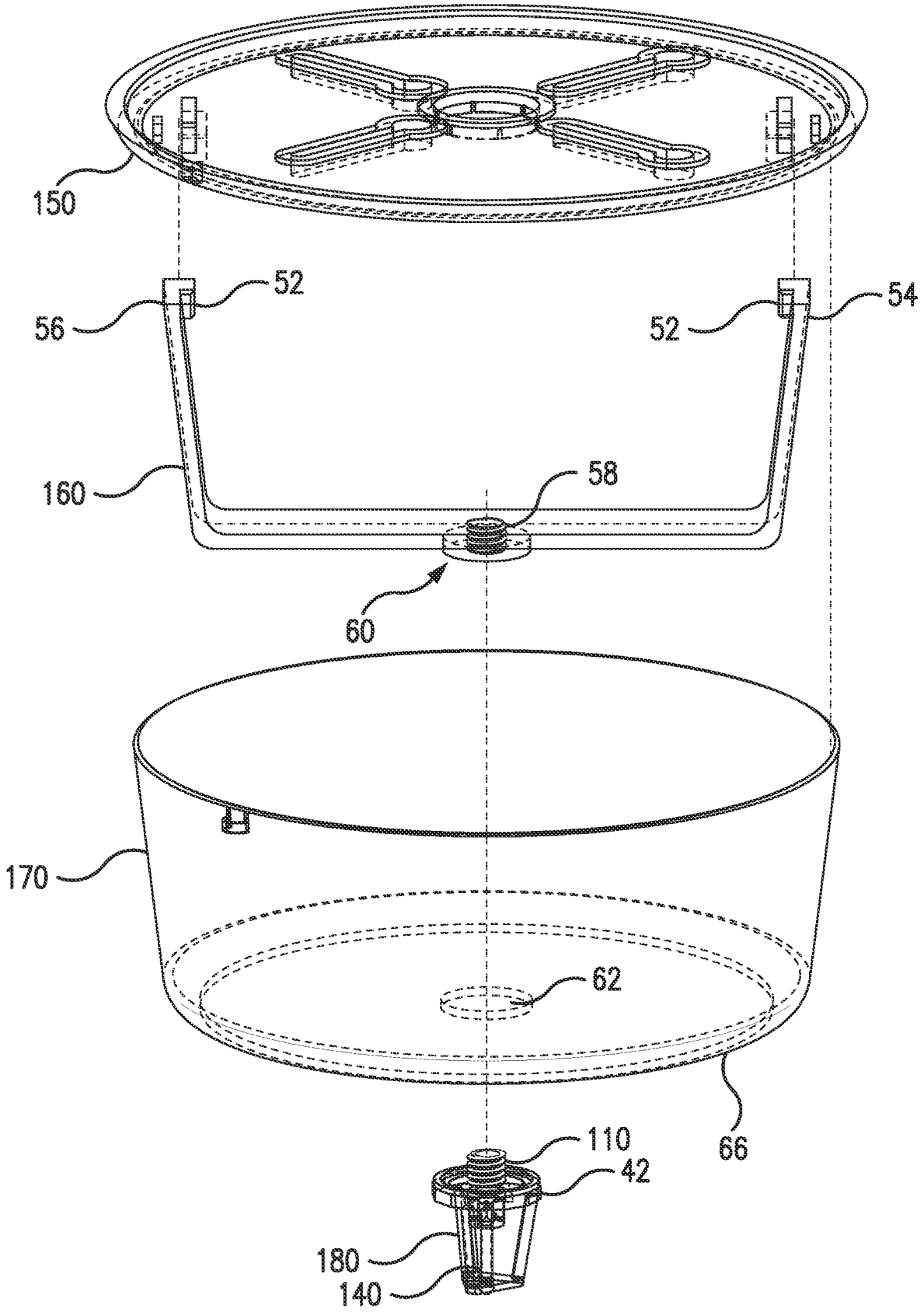
FIG. 2D is an exploded view of the subject thermal case with the assembled thermal bolt, the bridge extrusions, the mounting surface side of the mounting plate, and detailed internal features.
Figure 2E:
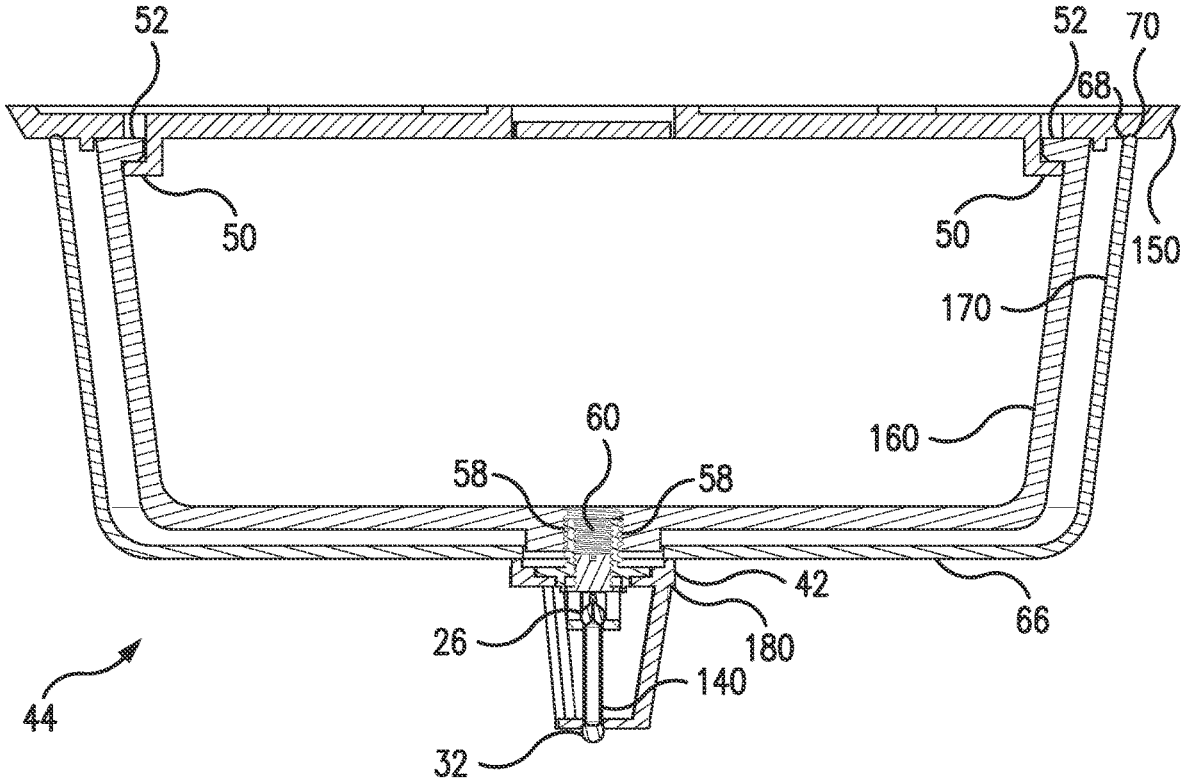
FIG. 2E is a side profile cross sectional view of the assembled thermal case and thermal bolt, showing the threaded interface between the thermal bolt and the bridge, and the thermal bolt securing the lid.
Figure 2F:
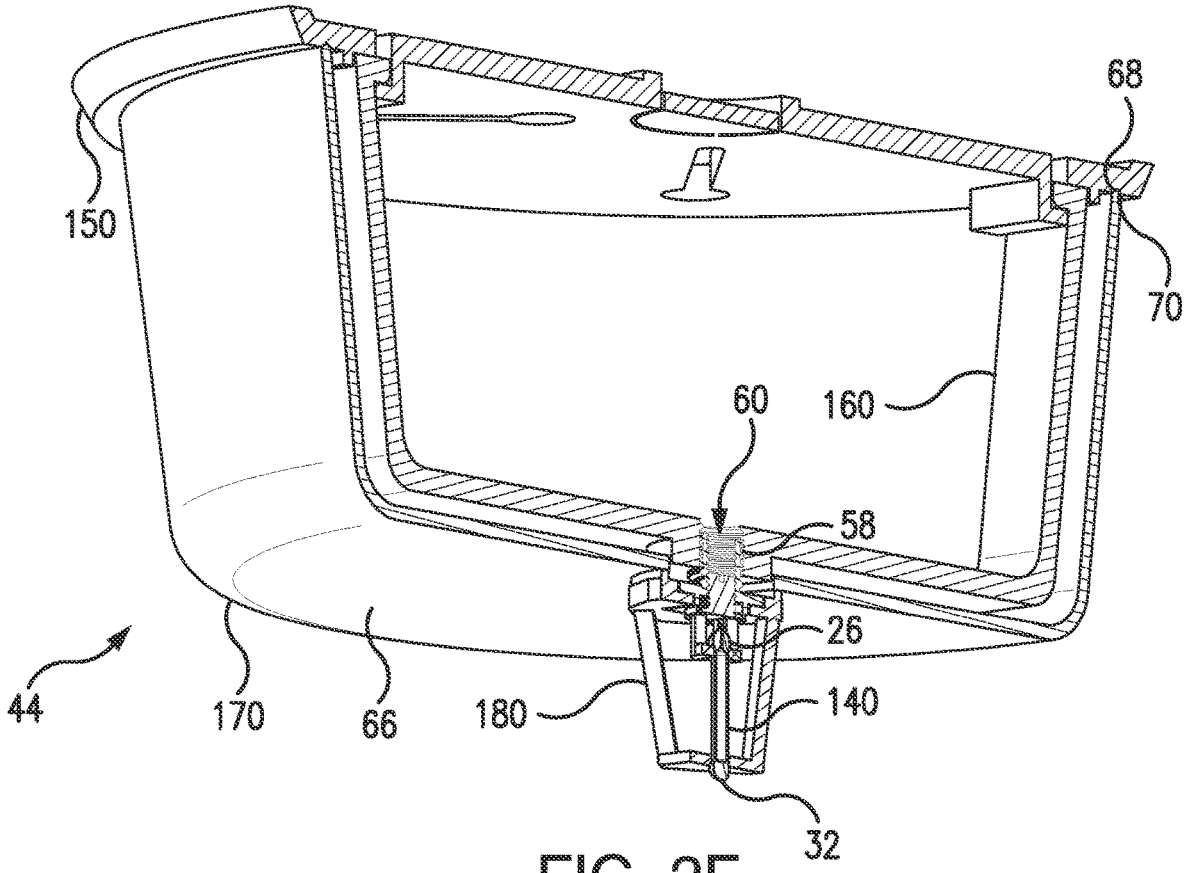
FIG. 2F is a cross sectional view of the assembled thermal case and thermal bolt, with the exterior of the thermal case and the smoke detector mounting side of the mounting plate visible.
Figure 2G:
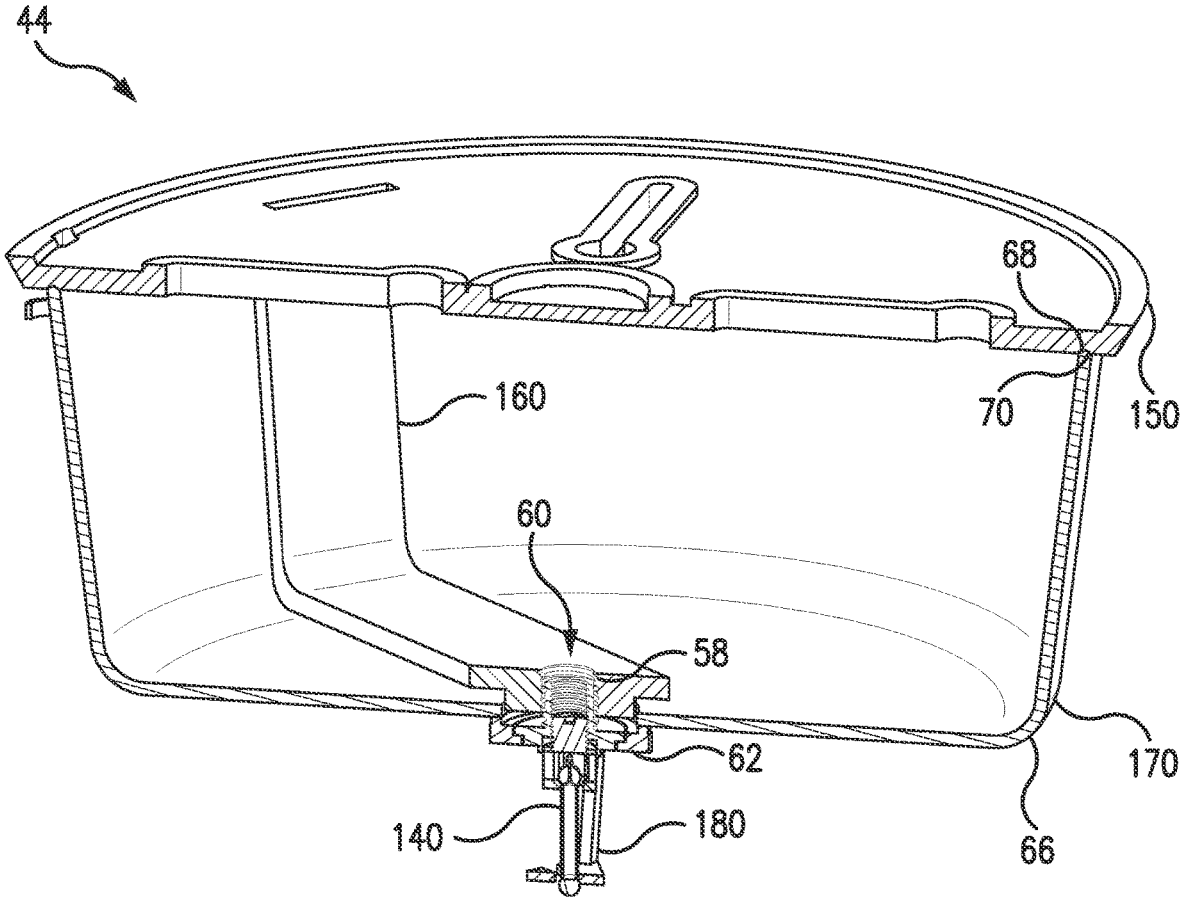
FIG. 2G is a cross sectional view of the assembled thermal case and thermal bolt, with the internal surface of the lid and internal bridge visible.

A circular "V" shaped groove 68 formed in proximity to the periphery in the mounting plate 150 seen in cross-sectional views in FIGS. 2E-2G, mates with the V shaped circumferential rim 70 of the lid 170 in a vacuum sealed fashion, thus restricting air movement between the lid 170 and the mounting plate 150, and thus preventing the lateral displacement of the lid 170 along the face of the mounting plate 150 once secured by the thermal bolt 180.

The lid 170, when held in place against the mounting plate 150 by the thermal bolt 180, screens the contents of the shielding structure 44 from exposure to exhaust gases, smoke, dust, dirt, moisture and other airborne particulates, and thus prevents the subject smoke detector system 10 from triggering the internally mounted smoke detector 200 and/or a smoke detector circuit board 270 (best shown in FIG. 6B) while the thermal element 140 in the thermal bolt 180 is intact (prior to reaching the threshold temperature). The thermal bolt 180, prior to be exposed to the threshold temperature, maintains the wholeness of the shielding structure 44 and covers and restricts the air movement through the central hole 62 formed in the lid 170.

The air movement is also restricted through any slots and/or punch outs present in the mounting plate 150 by a flat surface of the ceiling or a horizontal surface 220 to which the mounting plate 150 is adjacent when the shielding structure 44 is mounted properly, as shown in FIGS. 3A-3E. If the mounting plate 150 is mounted to a truss or other surface such that some slots or punch outs of the mounting plate 150 are not fully covered, the exposed sections of the mounting plate 150 slots or punch outs may be covered by a tape or other self-adhering material to complete the sealing of the shielding structure 44.

During a developing fire, when the thermal element 140 of the thermal bolt 180 ruptures, melts or separates due to the thermal element's temperature rising above the thermal element's rated temperature threshold, the bolt head 120 of the thermal bolt 180 is no longer held in compression against the threaded core 110 of the thermal bolt 180, and the force of gravity causes the bolt head 120 to drop away from the threaded core 110 and the lid 170. Subsequent to the bolt head 120 of the thermal bolt 180 falling away from the lid 170, the lid 170 is no longer held in compression by the thermal bolt 180, and the force of gravity causes the lid 170 to drop away from the mounting plate 150. As the lid 170 falls away from the mounting plate 150, the shielding of the smoke detector 200 and/or the smoke detector circuit board 270 mounted within the thermal shielding structure 44 ceases and the smoke detector 200 or smoke detector circuit board 270 becomes exposed to the surrounding air and/or smoke that was previously external to the sealed shielding structure 44. Once the lid 170 falls a distance equal to the length of safety tether 190, safety tether 190 arrests the further fall of the lid 170, thus preventing the lid 170 from damaging objects or injuring persons positioned directly beneath the lid 170, as shown in FIGS. 2D, 3A, and 3D-3E.

Following the dropping of the lid 170 and the bolt head 120 of the thermal bolt 180, if smoke is present in the air surrounding the internally mounted smoke detector 200 (FIGS. 3A,3D-3E) or a smoke detector circuit board 270 (FIG. 6B), an audible alarm may be sounded.

In one of the embodiments, the mounted smoke detector 200 or smoke detector circuit board 270 may contain a temperature sensing circuitry. In this implementation, an alarm may be triggered if the air temperature is above the temperature sensing circuitry's threshold temperature with or without the presence of smoke. If the smoke detector or smoke detector circuit board is connected wirelessly to other smoke detectors or an alarm base station, a wireless alert signal may be transmitted. If the smoke detector or smoke detector circuit board is hard wired to a central smoke detector alarm circuit, an alarm signal may be transmitted to the smoke detector alarm circuit via wire connection. Any contemporary methodology used by a smoke detector, or a smoke detector circuit board mounted within the subject shielding structure/thermal case to detect smoke and/or excessive heat, to sound an alarm or to transmit an alarm signal are applicable for use in the present smoke detector system.

In an alternative embodiment presented in FIG. 4, an ejection spring 250 is inserted between the internal bridge 160 and the lid 170. In this implementation, when the thermal case 44 is fully assembled, the lid 170 is held in compression against both the mounting plate 150 and the ejection spring 250 by the thermal bolt 180. While the lid 170 is in the assembled state, the ejection spring 250 is partially or fully compressed. At the time the thermal element 140 of the thermal bolt 180 changes its state, i.e., ruptures or melts, the ejection spring 250 decompresses thus returning to its full at-rest length, and thereby forcing the lid 170 to displace away from the mounting plate, thus exposing the smoke detector 200 to surrounding atmosphere. Utilization of the ejection spring 250 allows the shielding structure 44 of the subject smoke detector system 10 to be mounted on a non-horizontal surface 240, such as, for example, a wall or A-frame roofing truss. When the thermal case without the ejection spring 250 is mounted on a surface different than the bottom side of a horizontal surface such as a ceiling, there exists a possibility that the lid 170 may fail to fall away from the mounting plate 150 or come to rest on the internal bridge 160 or the smoke detector 200 when the thermal element 140 of the thermal bolt 180 ruptures, melts or collapses, which may result in preventing smoke from reaching the sensor of the smoke detector 200. The embodiment shown in FIG. 4 remedies such possibility.

Although FIG. 4 shows the ejection spring 250 as a conical compression spring, other types of springs or multiple springs are also contemplated in the subject system as long as they are capable of forcing the lid 170 a sufficient distance away from the mounting plate 150 to allow smoke to be sensed by the smoke detector 200.

Figure 5:
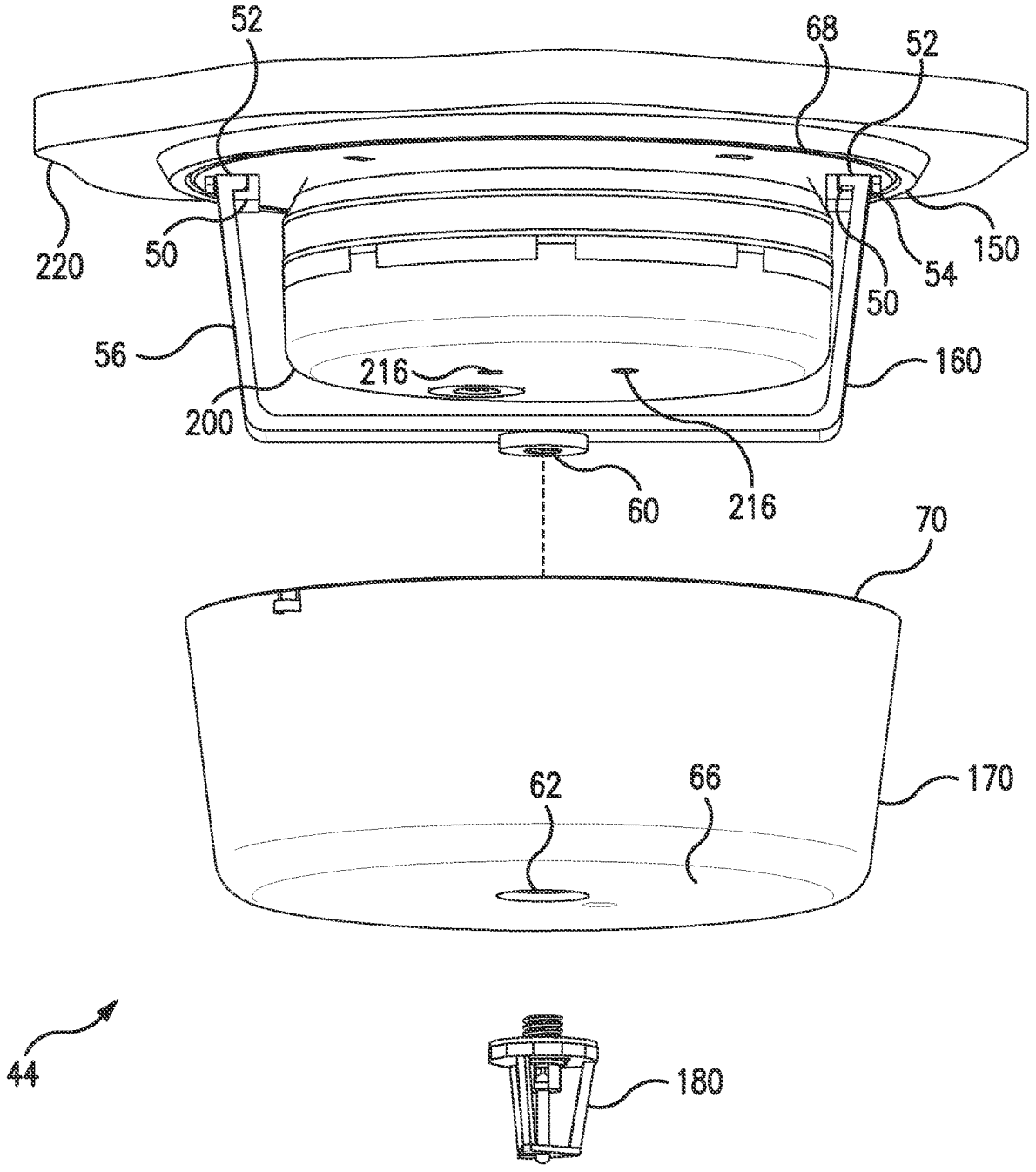
FIG. 5 shows an additional embodiment of the thermal case, a smoke detector body mounted directly to the thermal case's mounting plate without an intermediary smoke detector's mounting plate.

In another alternative embodiment shown in FIG. 5, the features of the smoke detector body/smoke detector mounting plate coupling mechanism found on the smoke detector mounting plate 210 presented in other implementations (for example, depicted in FIGS. 3A-3B,3D-3E, and 4) are integrated directly into the mounting plate 150, allowing the smoke detector 200 to be installed directly onto the mounting plate 150 without the intermediary smoke detector mounting plate 210. This embodiment reduces the cost of manufacturing and complexity of the system, as well as reduces the height of the lid 170 and the bridge 160 by the thickness of the smoke detector mounting plate 210 and eases the installation procedure. The embodiment depicted in FIG. 5 may be combined with the embodiment presented FIG. 4 to obtain the advantages of both embodiments.

Figure 6A:
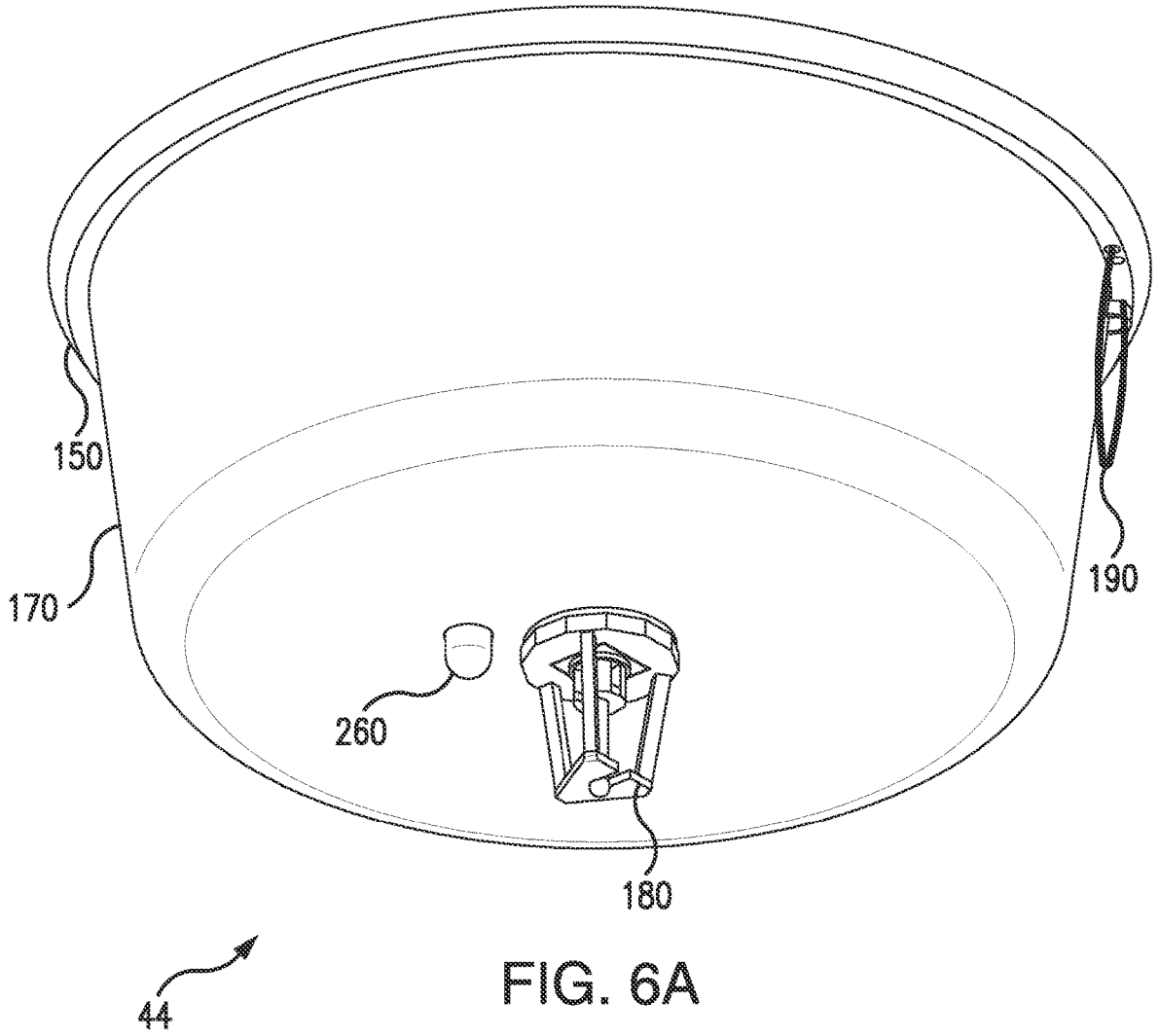
FIG. 6A depicts an additional embodiment formed of the thermal case, a smoke detector circuit board mounted directly onto the mounting plate with a test button/activation indicator that protrudes thru the lid.
Figure 6B:
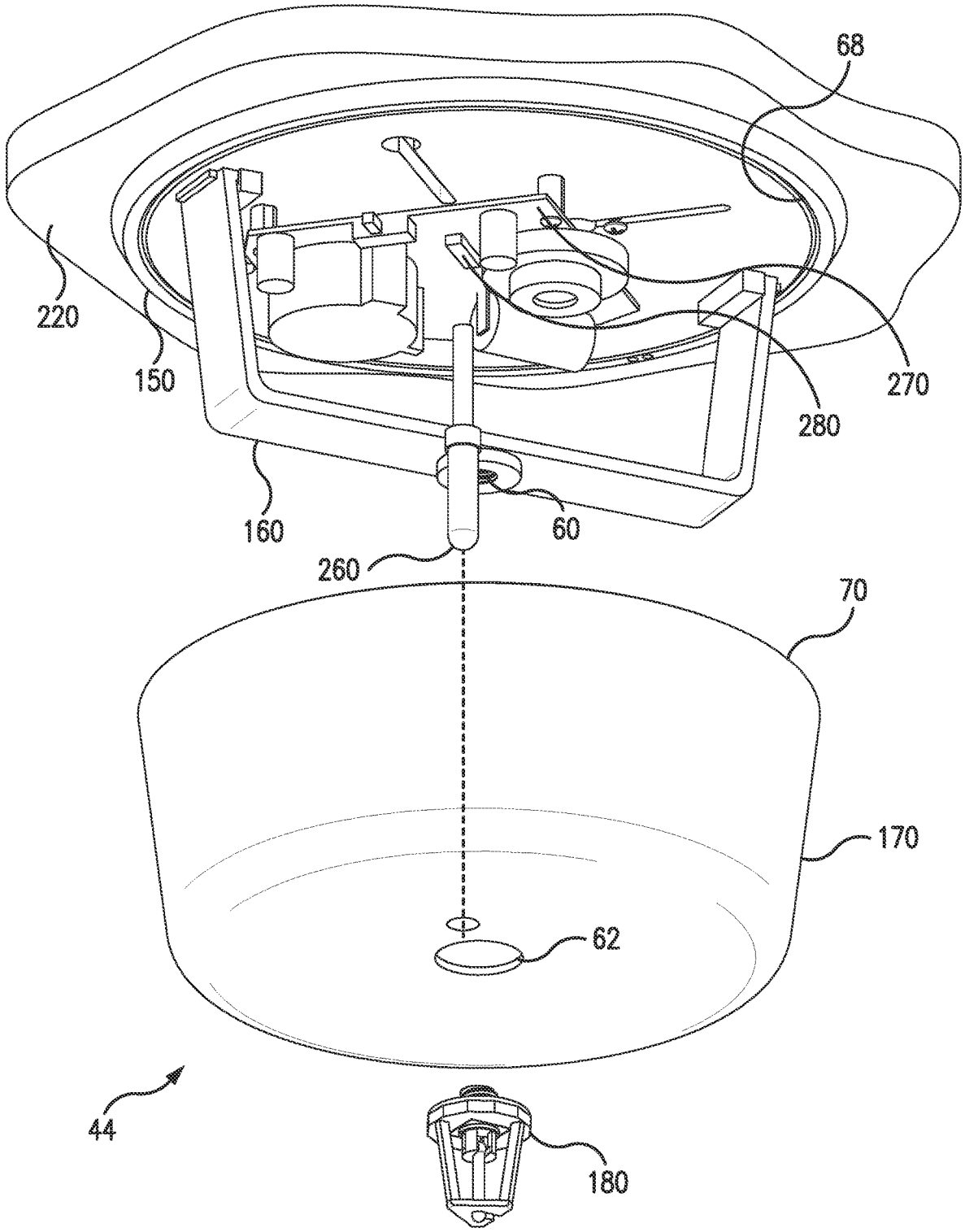
FIG. 6B is a partially exploded view of an additional embodiment of the present smoke detector system formed with the thermal case, a smoke detector circuit board mounted directly onto the mounting plate with a test button/activation indicator that protrudes thru the lid.
Figure 6C:
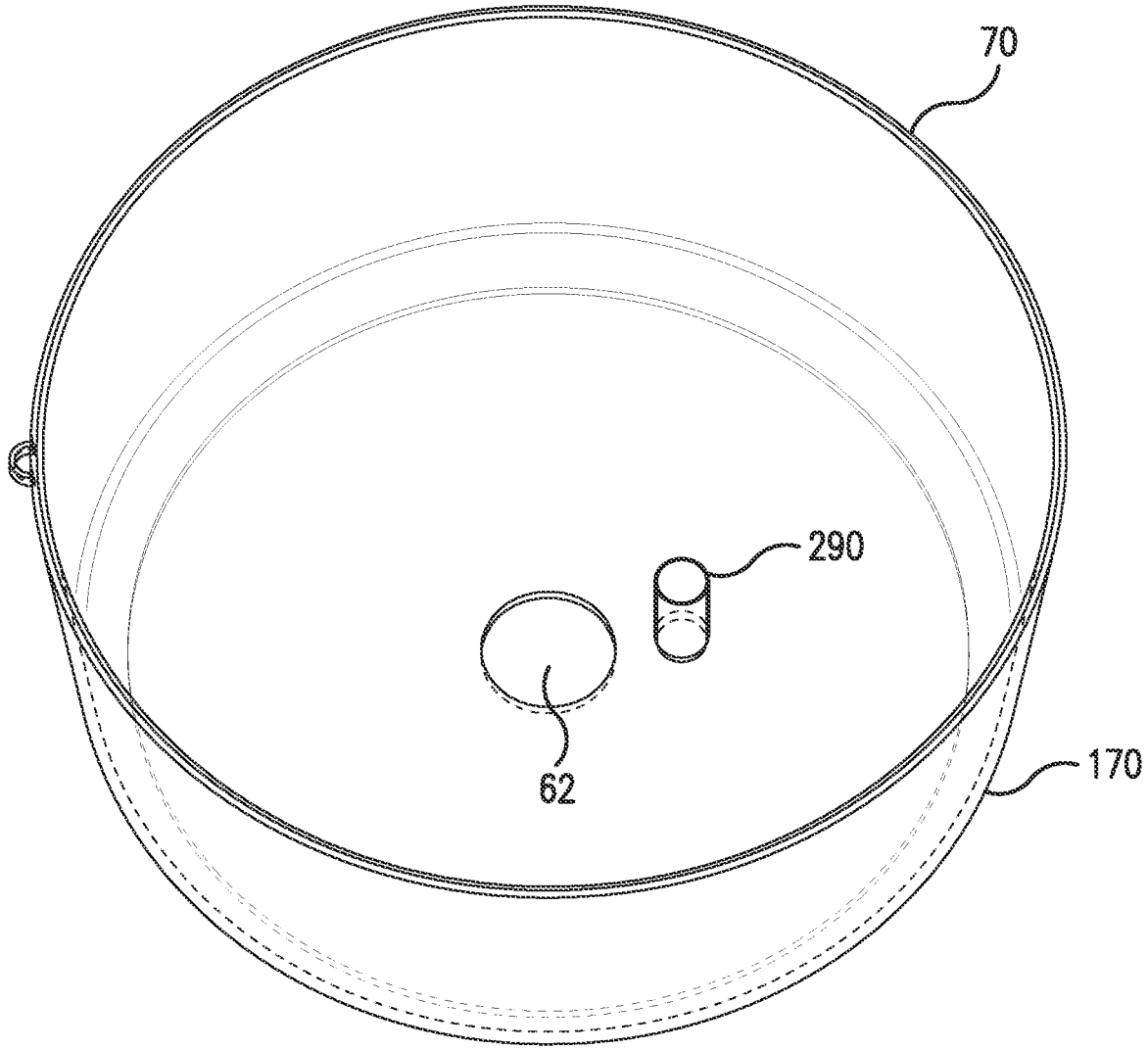
FIG. 6C shows an additional embodiment formed of the thermal case incorporating a smoke detector circuit board, showing, in hidden lines, the lid in which the lid test button guide feature of the lid is visible.
Figure 7A:
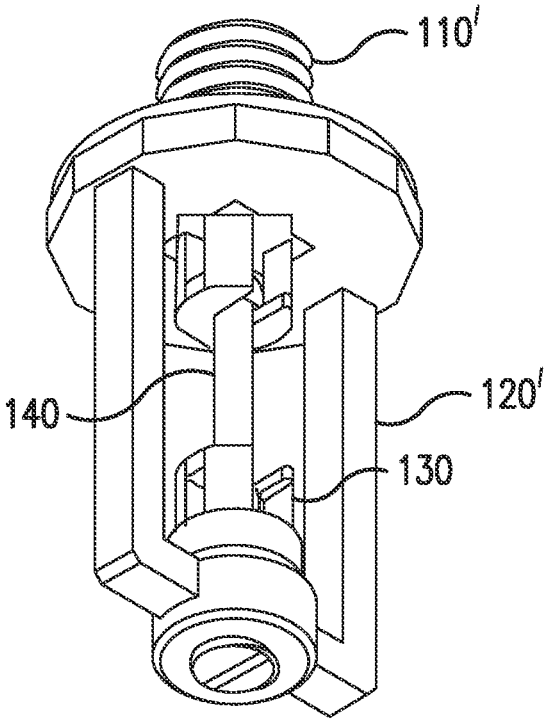
FIG. 7A shows an alternative embodiment of the subject thermal bolt in its assembled state and the capture of the thermal element by the threaded core.
Figure 7B:
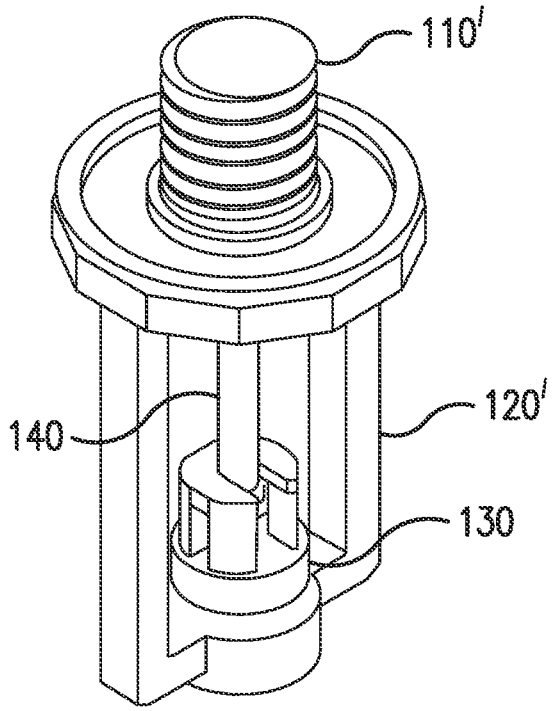
FIG. 7B shows an alternative embodiment of a thermal bolt in its assembled state and the capture of the thermal element by the tensioner.
Figure 7C:
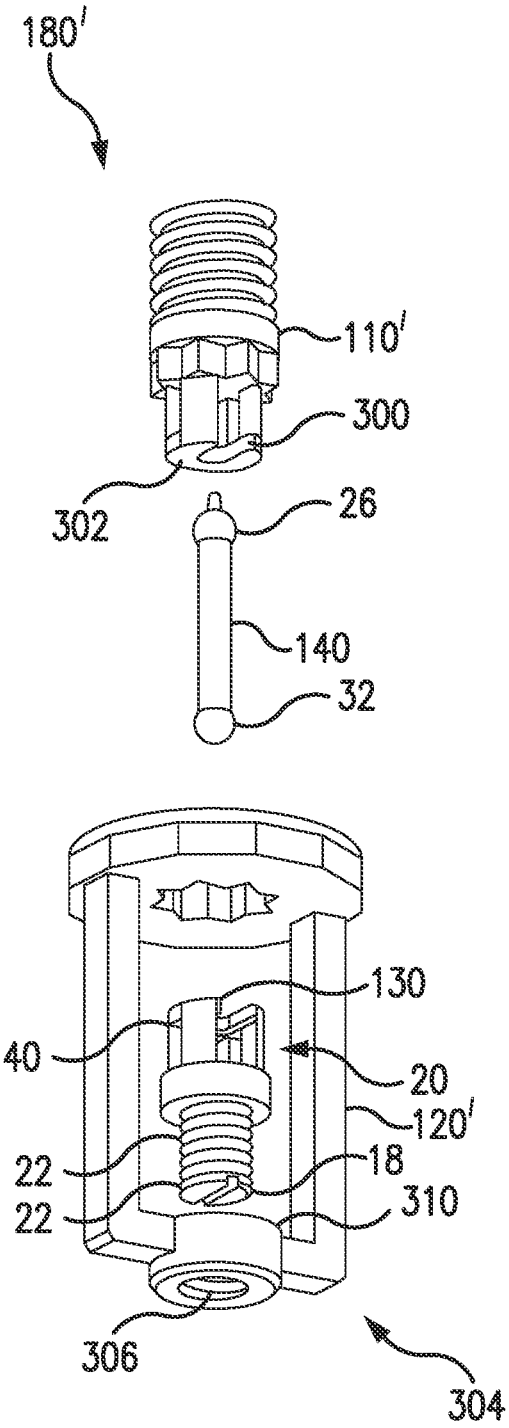
FIG. 7C shows an exploded view of an alternative embodiment of a thermal bolt with the thermal element support structure of the bolt head visible.
Figure 7D:
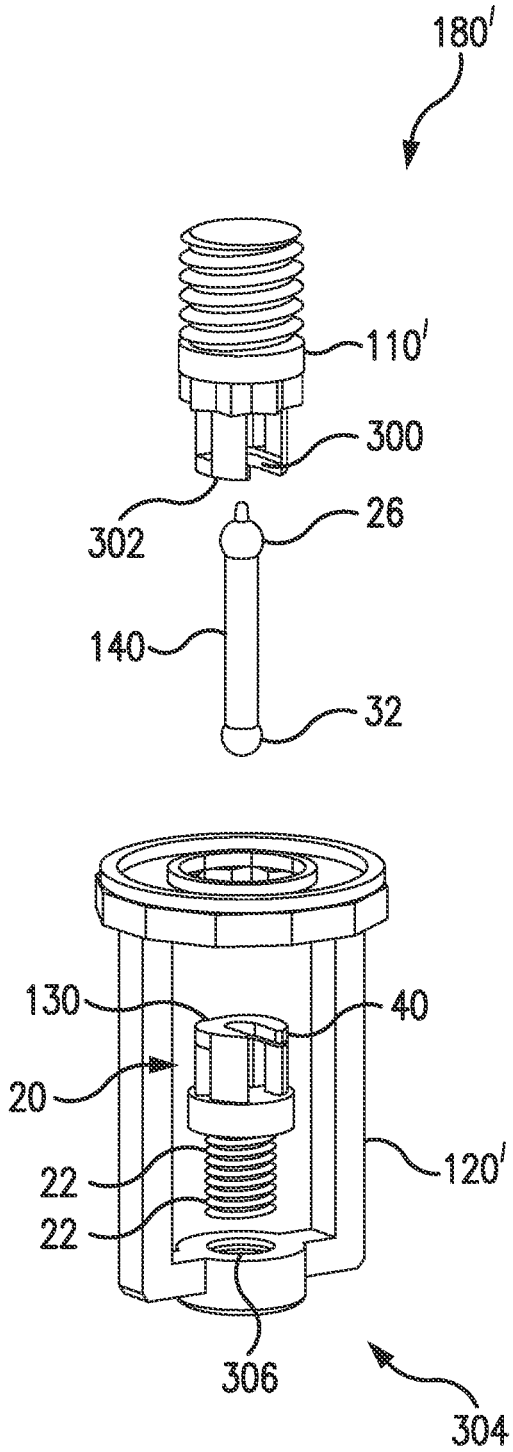
FIG. 7D shows an exploded view of an alternative embodiment of a thermal bolt with the tensioning feature end of the tensioner visible.
Figure 7E:
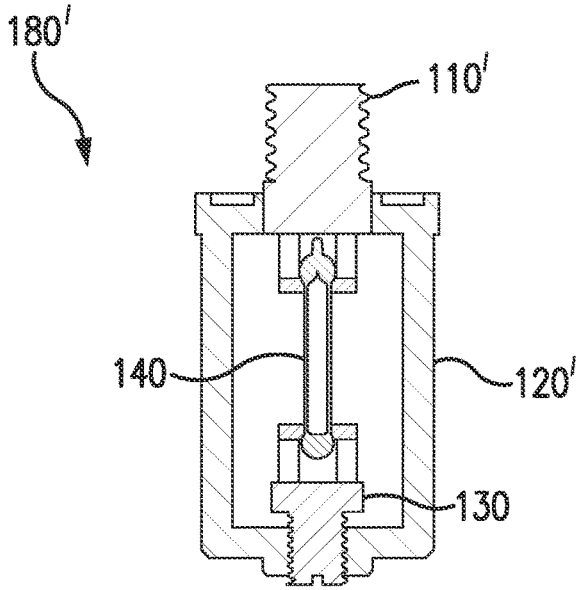
FIG. 7E shows a cross-sectional side view of an alternative embodiment of the assembled thermal bolt.
Figure 7F:
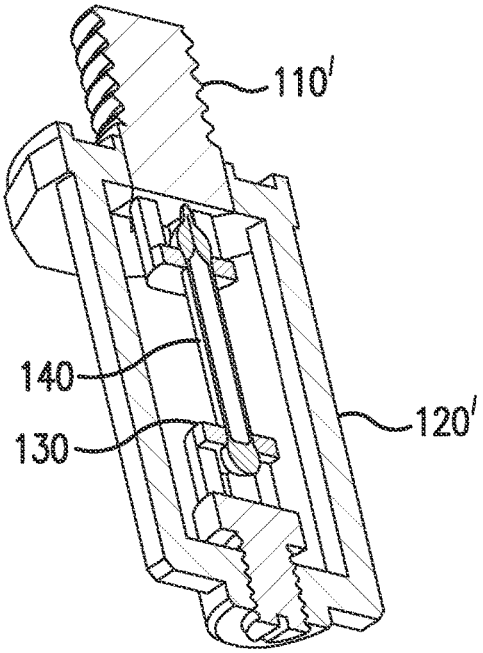
FIG. 7F shows a cross sectional view of an alternative embodiment of the assembled thermal bolt with the mating interface of the threaded core and bolt head visible, and the capture of the thermal element by both the tensioner and threaded core visible.
Figure 7G:
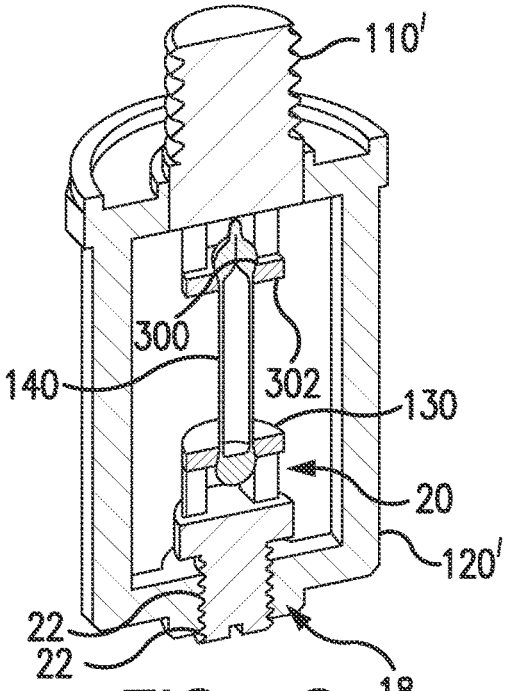
FIG. 7G shows a cross sectional view of an alternative embodiment of the assembled thermal bolt with the threaded side of the threaded core visible.

In the additional embodiment of the thermal case shown in FIGS. 6A-6C, the smoke detector circuit board 270 is directly mounted onto the mounting plate 150. Depending upon the type of the smoke detector circuit board, a long-life battery may be mounted on the circuit board, a replaceable battery may be installed onto the circuit board, or the smoke detector circuit board may be powered by an external hard wired power source. There would no longer exist any need for a separate smoke detector case or smoke detector mounting plate in this embodiment. The lid 170 in this embodiment contains a combined test button/activation indicator 260 that, when depressed, tests the smoke detector alarm circuitry and, when at rest, flashes periodically to indicate that the smoke detector is still operational. Depressing the test button/activation indicator 260 depresses the test switch 280 on the smoke detector circuit board 270. When not being depressed, the test switch 280 forces the test button/activation indicator 260 to seat against the lid test button guide 290 restricting the outside air from entering the thermal case around the edges of the test button/activation indicator 260.

The embodiment presented in FIGS. 6A-6C may be beneficial to both manufacturers and consumers in that only a single product has to be manufactured, purchased and installed. This reduces costs to both the manufacturer and customer. It also allows the manufacturer to limit the models of smoke detector circuit boards installed in a thermal case to those with specific features such as extra loud audible signaling horns or batteries capable of holding a charge for 10 years over the full range of temperatures found within a residential garage. A double-sided tape stuck on the external facing side of mounting plate 150 could be used for mounting instead of the mounting screws 230A and 230B (shown in FIG. 4) installed through the slots 214 formed in the mounting plate 150. Such implementation would allow the alternative embodiment shown in FIGS. 6A-6C to be fully installed by simply removing the remaining backing from the double-sided tape and pressing the thermal case mounting plate 150 against a ceiling or other horizontal surface, or non-horizontal surface when combined with the additional embodiment shown in FIG. 4. No mounting screw slots or punch-outs would be needed in the mounting plate 150, thus making the thermal case almost completely air tight until the thermal element ruptures, melts or separates. This embodiment is envisioned to be the simplest embodiment for a consumer to install, and might be the preferred embodiment for wireless alarm manufacturers who offer other types of sensors and smoke detectors with similar installation procedures.

In the alternative embodiment of the thermal bolt 180' shown in FIGS. 7A-FIG. 7G, the threaded core 110' is a solid unit, not internally threaded, with a feature 300 present on its mating interface 302 capable of capturing one end 26 of the thermal element 140. The bolt head 120' has a thermal element support structure 304 which contains a threaded hole 306 with an internal thread pitch that matches the pitch of the external threads 22 of the tensioner 130. The tensioner 130 screws into the threaded hole 306 of thermal element support structure 304 of the bolt head 120' from the side of the hole 306 closest to the bolt head 120' mating interface 310, allowing the thermal element 140 to be captured between the threaded core 110' and the tensioner 130. The features 40 located on the non-threaded portion 20 of the tensioner 130 allows a screwdriver or other tool (not shown in the Drawings) to be used to tighten the tensioner 130 as it is screwed into the threaded hole 306 of the bolt head 120'.

The alternative embodiment of a thermal bolt shown in FIGS. 7A-7G allows for the tension placed upon the thermal element 140 to be adjusted from the bolt head 120' end of the thermal bolt 180', saves on the manufacturing costs by avoiding the internal threading of the threaded core 110', and minimizes dimensions of the threaded core 110' which does not require an external thread diameter to be larger than the external thread diameter of the tensioner 130.

Although aspects of the present disclosure have been described in connection with specific forms and embodiments thereof, it will be appreciated that various modifications other than those discussed above may be resorted to without departing from the spirit or scope of the present disclosure as defined in the appended claims. For example, functionally equivalent elements may be substituted for those specifically shown and described, certain features may be used independently of other features, and in certain cases, particular locations of the elements may be reversed or interposed, all without departing from the spirit or scope of the present disclosure as defined in the appended claims.

What is claimed is:

1. A smoke detector system with a shielding controllable to cease once a threshold temperature indicative of a developing fire has been reached, the smoke detector system comprising:

a shielding structure containing at least a smoke detector, said shielding structure operating in a protective mode of operation or a monitoring mode of operation; and a thermal bolt assembly operatively coupled to said shielding structure to transform said shielding structure from said protective mode of operation to said monitoring mode of operation, said thermal bolt assembly being configured with:

a bolt head having a mating interface and a thermal element support structure, a threaded core having an externally threaded end and a mating interface end, a tensioner configured with an externally threaded portion and a thermal element capture portion, and a thermal element configured for sensing heat and changing a state of said thermal element upon exposure to a threshold temperature of a predetermined value, and captured between said thermal element support structure of said bolt head and said thermal element capture portion of said tensioner;

wherein, prior to reaching the threshold temperature, the tensioner applies a tensile force to said thermal element and interlocks said bolt head with said threaded core by applying a compressive force thereto, thus controlling said shielding structure to operate in the protective mode of operation, and wherein, upon reaching the threshold temperature, said thermal element changes the state thereof, thus releasing the compressive force interlocking the bolt head and threaded core, thus releasing said bolt head from said threaded core, and thus controlling said shielding structure to transform into said monitoring mode of operation.

2. The smoke detector system of claim 1, wherein said thermal element changes the state thereof by rupturing, melting, or collapsing.

3. The smoke detector system of claim 1, wherein said mating interface end of said threaded core is maintained in a releasable mating engagement with said mating interface of said bolt head, thus maintaining the threaded core disposed substantially in perpendicular to a face of said bolt head distal to the thermal element support structure, and permitting rotational forces applied to said bolt head perpendicular to a longitudinal axis of said threaded core to be applied to the threaded core.

4. The smoke detector system of claim 1, wherein said threaded core is configured as an internally threaded hollow structure having internal threads, wherein the external threads on said externally threaded portion of said tensioner have a thread pitch matching a thread pitch of said internal threads of said internally threaded hollow structure of said threaded core, and wherein, when the tensioner is threadedly engaged in the mating interface of said threaded core with the thermal element captured by the tensioner and the bolt head, the thermal element is exposed to the tension, and the bolt head is pulled towards the threaded core until the mating interface of the threaded core mates with the mating interface of the bolt head, thereby forcing the bolt head into compression against the threaded core, and interlocking the bolt head with the threaded core.

5. The smoke detector system of claim 1, wherein the threaded core is a solid structure having a thermal element capture portion extending from the mating interface end, wherein the thermal element support structure of the bolt head is configured with a threaded hole distal to the mating interface and having internal threads, and wherein external threads on the externally threaded portion of the tensioner have a thread pitch matching a thread pitch of the internal threads of the threaded hole of the thermal element support structure of the bolt head, wherein the tensioner is threadedly engaged with the threaded hole of the thermal element support structure of the bolt head with the thermal element captured by the tensioner and the threaded core placing the thermal element into tension, pulling the threaded core towards the bolt head until the threaded core mating interface mates with the bolt head mating interface, thus forcing the bolt core into compression against the threaded core, and interlocking the bolt head with the threaded core.

6. The smoke detector system of claim 1, wherein said shielding structure further includes:

an internal bridge, wherein the internal bridge is configured with a threaded hole with an internal thread having a pitch matching a pitch of external threads of the threaded core, a mounting plate configured with locking elements for releasable coupling with said internal bridge, a lid, the lid being configured with a central hole having a diameter exceeding a diameter of the threaded hole formed in the internal bridge and smaller than dimensions of the bolt head of the thermal bolt, wherein the threaded core of the thermal bolt passes through the central hole of the lid and threadedly engages with the threaded hole of the internal bridge with the bolt head covering the central hole of the lid, thus placing the lid in compression against the mounting plate, wherein the lid has a shaped edge fitting into a matching groove formed on the mounting plate, thus providing a sealing interface between the lid and the mounting plate while preventing lateral movement of the lid along the mounting plate surface, wherein the lid is secured against the mounting plate and is maintained in compression with the shaped edge of the lid received in the matching groove of the mounting plate by the internal bridge and the thermal bolt when the thermal element of the thermal bolt remains at a temperature below the threshold temperature, and wherein the lid is released from compression and separates from the mounting plate when the thermal element of the thermal bolt reaches the threshold temperature and changes the state thereof; and a safety tether coupled between the mounting plate and the lid.

7. The smoke detector system of claim 6, being mounted at a bottom surface of a horizontal support, wherein, upon the thermal element changes the state thereof due to a rise in temperature above the threshold temperature, the bolt head of the thermal bolt separates from the threaded core of the thermal bolt, thus eliminating the compressive force applied to the lid, and the lid is released from the mounting plate, thus ceasing the sealing of said at least smoke detector inside said shielding structure.

8. The smoke detector system of claim 6, being mounted on a non-horizontal supporting surface, further comprising:

at least one lid ejection spring, wherein, upon the thermal element changing the state thereof due to a rise in temperature above the threshold temperature, the bolt head of the thermal bolt separates from the threaded core of the thermal bolt, thus eliminating the compressive force applied to the lid, and said at least one lid ejection spring pushes the lid away from the mounting plate.

9. The thermal case of claim 6, wherein the mounting plate is formed with a smoke detector mounting configuration, wherein the smoke detector is directly mounted to the mounting plate of said smoke detector mounting configuration.

10. The smoke detector system of claim 6, further comprising:

a smoke detector circuit board, a test switch on the smoke detector circuit board, a smoke detector circuit board mounting configuration formed of said mounting plate to secure the smoke detector circuit board, a test button/activation indicator, wherein the test button/activation indicator is depressed to activate the test switch, and a lid test button guide, wherein the test button/activation indicator is disposed against the lid test button guide to keep the shielding structure sealed, and wherein the test button/activation indicator conveys a periodic light pulse generated by the smoke detector circuit board to indicate the operational status of the smoke detector circuit board;

wherein the smoke detector circuit board is shielded while surrounding temperature remains below the threshold temperature, and wherein the smoke detector circuit board is unshielded when a temperature rise causes the thermal element to change the state thereof, thus releasing the bolt head and lid, and the lid falling away a sufficient distance from the mounting plate to no longer obstruct or shield the smoke detector circuit board.

11. A method of sealing a smoke detector or smoke detector circuit board until a threshold temperature is reached, comprising:

mounting a smoke detector or smoke detector circuit board within a thermal case, mounting the thermal case to a supporting surface, wherein, the smoke detector or smoke detector circuit board, while mounted and sealed in the thermal case, being incapable of detecting the presence of smoke in the air external to the thermal case, and wherein the smoke detector or smoke detector circuit board remain sealed within the thermal case until the thermal element of the thermal bolt of the thermal case reaches the threshold temperature.

12. The method of claim 11, further comprising:

operating said a thermal case in a protective mode of operation prior to reaching the threshold temperature, and operating said thermal case in a monitoring mode of operation upon reaching the threshold temperature.

13. The method of claim 12, further comprising:

operatively coupling a thermal bolt assembly to said thermal case to transform said thermal case from said protective mode of operation to said monitoring mode of operation, and configuring said thermal bolt assembly with:

a bolt head having a mating interface and a thermal element support structure, a threaded core having an externally threaded end and a mating interface end, a tensioner configured with an externally threaded portion and a thermal element capture portion, and a thermal element configured for sensing heat and changing a state of said thermal element upon exposure to a threshold temperature of a predeterminer value and captured between said thermal element support structure of said bolt head and said thermal element capture portion of said tensioner.

14. The method of claim 13, further comprising:

prior to reaching the threshold temperature, applying a tensile force from the tensioner to said thermal element, and interlocking said bolt head with said threaded core by applying a compressive force thereto, thus controlling said thermal core to operate in the protective mode of operation, and upon reaching the threshold temperature, changing the state of said thermal element, and releasing the compressive force interlocking the bolt head and threaded core, thus releasing said bolt head from said threaded core, and thus controlling said thermal core to transform into said monitoring mode of operation.

15. The method of claim 14, further comprising:

configuring said thermal core with:

an internal bridge configured with a threaded hole with an internal thread having a pitch matching a pitch of external threads of the threaded core, a mounting plate configured with locking elements for releasable coupling with said internal bridge, a lid configured with a central hole having a diameter exceeding a diameter of the threaded hole formed in the internal bridge and smaller than dimensions of the bolt head of the thermal bolt, wherein the threaded core of the thermal bolt passes through the central hole of the lid and threadedly engages with the threaded hole of the internal bridge with the bolt head covering the central hole of the lid, thus placing the lid in compression against the mounting plate.

16. The method of claim 15, further comprising:

configuring the lid with a shaped edge, fitting said shaped edge of the lid into a matching groove formed on the mounting plate, thus providing a sealing interface between the lid and the mounting plate while preventing lateral movement of the lid along the mounting plate surface, wherein the lid is secured against the mounting plate and is maintained in compression with the shaped edge of the lid received in the matching groove of the mounting plate by the internal bridge and the thermal bolt when the thermal element of the thermal bolt remains at a temperature below the threshold temperature, and wherein the lid is released from compression when the thermal element of the thermal bolt reaches the threshold temperature and changes the state thereof;

and ruptures, melts or separates.

17. The method of claim 15, further comprising:

changing the state of the thermal element of the thermal bolt upon reaching the threshold temperature, releasing the bolt head of the thermal bolt and the lid of the thermal case, wherein the lid of the thermal case lid separates from the mounting plate of the thermal case by falling under gravity force or by pushing by a lid ejection spring, until the separation of the lid of the thermal case is arrested by a safety tether, unsealing the smoke detector or smoke detector circuit board to expose to surrounding atmosphere outside of the thermal case, and enabling the smoke detector or smoke detector circuit board to detect the presence of smoke in the air.

18. A method of assembling a system configured with at least two objects, comprising:

(a) assembling a thermal bolt module containing:

a bolt head having a mating interface and a thermal element support structure, a threaded core having an externally threaded end and a mating interface end, a tensioner configured with an externally threaded portion and a thermal element capture portion, and a thermal element configured for sensing heat and changing a state of said thermal element upon exposure to a threshold temperature of a predeterminer value, and captured between said thermal element support structure of said bolt head and said thermal element capture portion of said tensioner;

(b) providing a first object and a second object, (c) configuring the first object with a threaded hole having a thread pitch matching a thread pitch of external threads on said externally threaded end of the threaded core, (d) configuring the second object with a hole, (e) screwing said thermal bolt module into said threaded hole of said first object through said hole formed in said second object, and (f) releasing the second object by unscrewing the thermal bolt module from the first object and removed from the hole in the second object, thus releasing the second object, or by exposing the thermal element to the threshold temperature and changing the state thereof, thus freeing the bolt head from the threaded core, and thus releasing the second object.

* * * * *